US007305847B2

(12) United States Patent
Wolski et al.

(10) Patent No.: US 7,305,847 B2
(45) Date of Patent: Dec. 11, 2007

(54) COLD CARBONATION SYSTEM FOR BEVERAGE DISPENSER WITH REMOTE TOWER

(76) Inventors: Peter F. Wolski, 750 N. Rush St., #2201, Chicago, IL (US) 60611; Thaddeus M. Jablonski, 243 Richards Dr., Palatine, IL (US) 60074; Kyle B. Elsom, 2717 W. Wilson, Batavia, IL (US) 60510; Eric Schertz, 609 Philip Dr., Bartlett, IL (US) 60103; Daniel C. Leaver, 22 E. 60th St., Westmont, IL (US) 60559; Kevin Brandt, 323 Sharon Dr., Barrington, IL (US) 60010; Todd Manisco, 562 Horizon Dr. W., St. Charles, IL (US) 60175

( * ) Notice: Subject to any disclaimer, the term of this patent is extended or adjusted under 35 U.S.C. 154(b) by 45 days.

(21) Appl. No.: 11/091,327

(22) Filed: Mar. 28, 2005

(65) Prior Publication Data

US 2006/0021372 A1 Feb. 2, 2006

Related U.S. Application Data

(60) Provisional application No. 60/559,240, filed on Apr. 3, 2004, provisional application No. 60/573,882, filed on May 24, 2004.

(51) Int. Cl.
*B67D 5/62* (2006.01)

(52) U.S. Cl. ..... 62/390; 62/434; 222/146.6

(58) Field of Classification Search ..... 62/389–400, 62/430–439; 222/129–129.1, 146.6
See application file for complete search history.

(56) References Cited

U.S. PATENT DOCUMENTS

| | | | | |
|---|---|---|---|---|
| 5,524,452 | A * | 6/1996 | Hassell et al. | 62/389 |
| 5,974,824 | A * | 11/1999 | Galockin et al. | 62/394 |
| 6,463,753 | B1 * | 10/2002 | Haskayne | 62/389 |
| 6,560,972 | B2 * | 5/2003 | Ubidia | 62/59 |
| 6,698,229 | B2 * | 3/2004 | Renken et al. | 62/390 |
| 6,725,687 | B2 | 4/2004 | McCann et al. | |
| 7,036,326 | B2 * | 5/2006 | Allison | 62/59 |
| 2005/0120737 | A1 * | 6/2005 | Borror et al. | 62/434 |

* cited by examiner

*Primary Examiner*—William E. Tapolcai
(74) *Attorney, Agent, or Firm*—Pyle & Piontek, LLC

(57) ABSTRACT

A beverage dispensing system is characterized by an ice/beverage dispenser and a remote beverage tower. The dispenser has a cold plate, a carbonator pump and a carbonator tank and the tower has a carbonator tank. To chill the tower carbonator tank, a closed loop fluid circuit extends between and heat exchange couples the dispenser cold plate and the tower carbonator tank. The dispenser carbonator pump can be used to circulate water through the closed loop circuit or a carbonator pump for the tower can be used for the purpose. A valve arrangement is provided for and as part of the dispenser cold plate to conveniently enable the dispenser to be switched between stand-alone operation and operation as a base unit for the remote tower. Arrangement is also made to cause ice agitation at the dispenser in response to drinks dispense at the remote tower to maintain a supply on the cold plate.

28 Claims, 15 Drawing Sheets

| MODE | DESCRIPTION |
|---|---|
| NORMAL/STANDBY | RE-CIRCULATION OF CHILLED WATER THROUGH COOLING COIL 84 OF REMOTE TOWER 52 |
| FILL CARBONATOR TANK 62 OF ICE/BEVERAGE DISPENSER 10 | CLOSE FLOW TO COOLING COIL 84 AT REMOTE TOWER 52 AND OPEN FLOW TO FILL CARBONATOR TANK 62 OF ICE/BEVERAGE DISPENSER 10 |
| FILL CARBONATOR TANK 50 OF REMOTE TOWER 52 | CLOSE FLOW TO COOLING COIL 84 AT REMOTE TOWER 52 AND OPEN FLOW TO FILL CARBONATOR TANK 50 REMOTE TOWER |

FIG. 7

| MODE | N.O. SOLENOID AT CARBONATOR PUMP INLET | N.C. SOLENOID AT INLET TO CARBONATOR TANK 62 | N.C. SOLENOID AT INLET TO REMOTE CARBONATOR TANK 50 |
|---|---|---|---|
| NORMAL/STANDBY | OPEN | CLOSED | CLOSED |
| FILL CARBONATOR 62 | CLOSED | OPEN | CLOSED |
| FILL CARBONATOR 50 | CLOSED | CLOSED | OPEN |

FIG. 8

COLD CARBONATION SYSTEM FOR BEVERAGE DISPENSER WITH REMOTE TOWER

This application claims benefit of provisional application Ser. No. 60/559,240, filed Apr. 3, 2004, and of provisional application Ser. No. 60/573,882, filed May 24, 2004.

FIELD OF THE INVENTION

The present invention relates generally to beverage dispensing systems, and in particular to ice/beverage dispensers having cold plates that are used as cooling engines chilling product to be delivered at a remote location.

BACKGROUND OF THE INVENTION

It is known in the beverage dispensing art to use combined ice and beverage dispensers that employ cooling engines, usually cold plates, to provide heat exchange cooling of various drinks. The ice/beverage dispenser is usually contained in a single cabinet, in an upper portion of which is an ice retaining bin and in a lower portion of which is a cold plate. The cold plate is cooled by a volume of ice gravity fed from a lower opening in the bin into the lower portion of the cabinet and onto and in heat exchange contact with the cold plate. The ice chills the cold plate which, in turn, provides for heat exchange cooling of beverage liquids flowed through tubing chilling circuits embedded in the cold plate. In situations where a cold plate is used in conjunction with a post-mix ice/beverage dispenser, sources of carbonated water and beverage syrup flavorings are connected to the cold plate to be cooled for delivery to post-mix beverage dispensing valves. Carbonated drinks are produced when the cooled carbonated water and syrup flavoring constituents are subsequently mixed together and dispensed from the post mix valves.

An ice/beverage dispenser customarily has four or more, and often eight or more, post-mix beverage dispensing valves for dispensing various selected beverages. The valves are normally positioned along a front surface of the dispenser, normally accommodating access to the dispenser by only one person at a time. In fast food restaurants where a number of customers may be awaiting service of beverage orders, the inability of more than one person at a time to access the dispenser can result in unwanted delays in servicing customers.

To decrease the time required to serve a number of beverages, it is known to utilize, together with an ice/beverage dispenser, a separate remote beverage dispensing tower that is coupled to the ice/beverage dispenser. A beverage dispensing tower typically is a simplified structure consisting primarily of a cabinet for carrying a limited number of post-mix beverage dispensing valves, but the tower customarily does not have either ice retaining and dispensing capability, a cold plate or associated sources of water and syrup. When a remote tower is to be coupled to a base unit comprising an ice/beverage dispenser, a challenge is to make the process of installation quick and efficient while maintaining at the tower good drink quality at required temperatures.

To provide for cooling of beverages that are dispensed from the tower, a cooling system is provided for the beverage liquids. The tower may be a considerable distance from the supplies of beverage liquids, which normally are located at the ice/beverage dispenser, and during idle periods when beverages are not being dispensed from the tower, plain and/or carbonated water and syrup flavorings in a python extending between supplies thereof and the tower can become warm, and if dispensed into a cup can result in an inferior beverage. So that a warm drink will not be dispensed, during idle periods when the tower is not in use it is known to recirculate the water between the cooling system and tower so that it will remain cold in the tubing.

Known systems for cooling plain and/or carbonated water delivered to a remote beverage dispensing tower make use of a mechanical refrigeration system to create a large ice bank in an agitated water bath or can comprise a cold plate. The water line(s) are immersed in the water bath for chilling prior to the water being delivered through a python to post-mix beverage dispensing valves of the remote tower. If desired, the syrup lines for the tower can also be immersed in the water bath for cooling or, alternatively, the syrup can be chilled by the syrup lines being in close heat exchange contact with the chilled water lines in the python. Incoming water to the tower, if not already carbonated, may be carbonated via a carbonator tank and water supply pump associated with the tower. While such refrigeration systems for beverage liquid components delivered to a remote tower are effective, they are expensive to implement and increasing cost constraints have resulted in a demand for less cost prohibitive solutions. A somewhat more economical approach is for the same carbonator as is used to deliver carbonated water to the primary ice/beverage dispenser to be used to provide carbonated water for the remote dispensing tower. However, a disadvantage of this arrangement is that during periods of peak use of the ice/beverage dispenser and remote tower, the ability of the carbonator to continuously deliver chilled carbonated water is compromised.

Establishments in which ice/beverage dispensers are used often serve various consumable items other than beverages, many of which require chilling either to maintain their quality or because they are perishable. Chilling of such products customarily is accomplished through use of a mechanical refrigeration system, which adds additional cost to the food service operation.

Ice/beverage dispensers utilize a cooling engine for chilling beverages served by the dispenser, which cooling engine customarily comprises a cold plate designed to have a cooling capacity sufficient to properly chill beverages served by a dispenser during periods of peak demand, with little surplus cooling capacity remaining during such periods. However, a cold plate could be made to have a cooling capacity in excess of the maximum required to fully meet the beverage chilling needs of a dispenser, in which case it could advantageously be used to chill liquid beverage components delivered to a remote beverage dispensing tower or to chill other remotely located products as may be served by the establishment where the ice/beverage dispenser is used. If an ice/beverage dispenser were made to have such a surplus capacity cold plate, then it would also be advantageous to provide the cold plate with some means that enables a user to selectively couple to one or more of its cooling circuits, without need for extensive modification of its plumbing, for convent transfer of its cooling capacity to a remote location. This would desirably enable a user of the ice/beverage dispenser to use the dispenser either as a stand-alone unit or to retrofit the dispenser so that its cold plate then serves as a cooling engine for product to be chilled at a remote location or to chill product for delivery to a remote location. In addition, because a cold plate depletes ice in contact with it when it is used in heat transfer cooling of product, it would be desirable to provide some means to ensure that a sufficient supply of ice always remains in contact with the cold plate.

OBJECTS OF THE INVENTION

An object of the present invention is to provide an ice/beverage dispenser a cold plate of which is adapted to serve as a cooling engine for product delivered to or chilled at a remote location.

Another object is to provide such an ice/beverage dispenser in which the dispenser cold plate is provided with means enabling convenient use of the dispenser as a stand-alone unit or retrofit of the dispenser so that its cold plate serves as a cooling engine for product delivered to or chilled at a remote location.

A further object of the invention is to provide such an ice/beverage dispenser in which its cold plate has surplus cooling capacity that is utilized by the dispenser when the cold plate is not otherwise serving as a cooling engine for other product.

Yet another object of the invention is to provide such an ice/beverage dispenser with a system that ensures that an adequate supply of ice always remains in heat exchange contact with its cold plate.

SUMMARY OF THE INVENTION

In accordance with the present invention, a beverage dispensing and chilling system comprises a beverage dispenser including a cold plate having fluid chilling circuits; a closed-loop fluid conveying circuit including at least one fluid chilling circuit of the cold plate, the closed-loop circuit extending between the beverage dispenser and a location remote from the dispenser; and means for circulating fluid through the closed-loop circuit to chill the fluid and to deliver the chilled fluid to the remote location.

In various embodiments of the system, the beverage dispenser has a pump and the circulating means includes the pump; the beverage dispenser has a pump and the circulating means includes a pump separate from the beverage dispenser pump; and the beverage dispenser comprises an ice and beverage dispenser.

Also in various embodiments, the system includes a product container at the remote location and the closed-loop fluid conveying circuit is heat exchange coupled with an exterior of the product container; the system includes a product container at the remote location and the closed-loop fluid conveying circuit has a portion within an interior of the container for heat exchange coupling to product in the container; the system includes a heat exchanger at the remote location and the closed-loop fluid conveying circuit includes at least one fluid circuit of the heat exchanger at the remote location for heat exchange chilling of the heat exchanger; and the system includes a product dispenser at the remote location, the chilled fluid circulated through the closed-loop circuit is product to be dispensed at the remote location and the closed-loop circuit is coupled to the product dispenser for delivering chilled product to the product dispenser.

In a further contemplated embodiment, the cold plate fluid chilling circuits include a first fluid chilling circuit for chilling a beverage component for dispensing by the beverage dispenser and a second fluid chilling circuit and the at least one fluid chilling circuit of the closed-loop fluid conveying circuit comprises the second fluid chilling circuit. The beverage dispenser includes valve means having a first state for coupling the cold plate second fluid chilling circuit imine with the closed-loop fluid conveying circuit and a second state for removing the second fluid chilling circuit from the closed-loop fluid convening circuit and for instead fluid coupling the second fluid chilling circuit to be in fluid circuit with the first chilling circuit for chilling of the beverage component by both the first and second cold plate fluid chilling circuits.

In another embodiment, the system includes a remote tower at the remote location and the closed-loop fluid conveying circuit is heat exchange coupled to the remote tower for chilling a beverage component to be dispensed at the remote tower. The remote tower can include a carbonator tank and the closed-loop fluid conveying circuit can then be heat exchange coupled to the carbonator tank. The beverage dispenser can also include a carbonator tank and a carbonator pump for delivering water to an inlet to the carbonator tank, and means are provided for coupling the beverage dispenser carbonator pump to the closed-loop fluid conveying circuit for circulating fluid through the closed-loop circuit. The fluid circulated through the closed-loop fluid conveying circuit may be water, in which case the system includes means for coupling the closed-loop fluid conveying circuit to an inlet to the remote tower carbonator tank to deliver water into the tank. The remote tower may have a carbonator tank and a carbonator pump for delivering water to an inlet to the remote tower carbonator tank, in which case the closed-loop fluid conveying circuit can include the remote tower carbonator pump for circulation of fluid through the closed-loop circuit.

The invention also contemplates maintaining a supply of ice on the cold plate in response to loading of the cold plate by the remote tower. In this case, a beverage dispensing system comprises a beverage dispenser having a cold plate with fluid chilling circuits and a remote beverage dispensing tower including at least one beverage valve for dispensing a beverage. Further included are a beverage component conveying circuit for delivering a beverage component to the remote tower for being dispensed at the tower, the beverage component conveying circuit extending between the beverage dispenser and the remote tower and including at least one fluid chilling circuit of the cold plate for chilling the beverage component, and means responsive to dispensing of beverage at the remote tower for delivering ice to the cold plate.

The invention also contemplates a method of providing chilling at a location remote from a beverage dispenser having a cold plate with a plurality of fluid chilling circuits. The method comprises the steps of flowing fluid through at least one of the cold plate fluid chilling circuits to chill the fluid; and delivering the chilled fluid to the location remote from the beverage dispenser.

The beverage dispenser may be an ice and beverage dispenser, in which case included is the step of using ice to chill the cold plate of the dispenser.

The beverage dispenser may include a pump, and the delivering step then comprises using the pump to deliver the chilled fluid to the location remote from the beverage dispenser. Alternatively, where the beverage dispenser includes a pump, the delivering step can comprise using another separate pump to deliver the chilled fluid to the location remote from the beverage dispenser.

In various contemplated practices of the method, product is in a container at the remote location, and included is the step of heat exchange coupling the chilled fluid delivered to the remote location to the container; product is in a container at the remote location, and included is the step of heat exchange coupling the chilled fluid delivered to the remote location to the product in the container; product is in contact with a heat exchanger at the remote location, and included is the step of flowing the chilled fluid delivered to the remote location through a fluid circuit of the heat exchanger at the remote location; a product dispenser is at the remote location, the chilled fluid delivered to the remote location is product, and included is the step of coupling the chilled product delivered to the remote location to the product dispenser for dispensing of the chilled product by the product dispenser.

It is contemplated that the plurality of cold plate fluid chilling circuits include at least one beverage component chilling circuit and at least one auxiliary fluid chilling circuit, and that the flowing step comprises flowing fluid through the at least one auxiliary chilling circuit. Also included are the steps of flowing a beverage component through the at least one beverage component chilling circuit, and using at least one valve to control fluid placement of the at least one auxiliary fluid chilling circuit, such that in a first state of the at least one valve, the flowing step flows fluid through the at least one cold plate auxiliary fluid chilling circuit and, in a second state of the at least one valve, the auxiliary fluid chilling circuit is switched to be in fluid circuit with the at least one beverage component chilling circuit, so that in the second state of the at least one valve, the step of flowing a beverage component flows the beverage component through both the at least one beverage component chilling circuit and the at least one auxiliary fluid chilling circuit.

The at least one valve, in each of its first and second states, may be used to couple a supply of the beverage component to the at least one cold plate beverage component chilling circuit.

In a contemplated practice of the method, the chilled fluid delivered to the remote location is heat exchange coupled to a beverage dispensing tower at the remote location. If the remote tower has its own carbonator tank, then the chilled fluid delivered to the remote location may be heat exchange coupled to the carbonator tank at the remote location.

A method of maintaining a supply of ice on the beverage dispenser cold plate in response to loading of the cold plate by the remote tower is also contemplated. According to this aspect of the invention, the steps involved in dispensing beverages include fluid coupling a fluid chilling circuit of a beverage dispenser cold plate to a remote tower to chill a beverage component dispensed by the remote tower; dispensing beverage at the remote tower; and, in response to performance of the dispensing step, delivering ice to the beverage dispenser cold plate.

The foregoing and other objects, advantages and features of the invention will become apparent upon a consideration of the following detailed description, when taken in conjunction with the accompanying drawings.

BRIEF DESCRIPTION OF THE DRAWINGS

FIGS. 7 and 8 are charts showing three different modes of operation of apparatus embodying the teachings of the invention;

DETAILED DESCRIPTION

Figure 1:
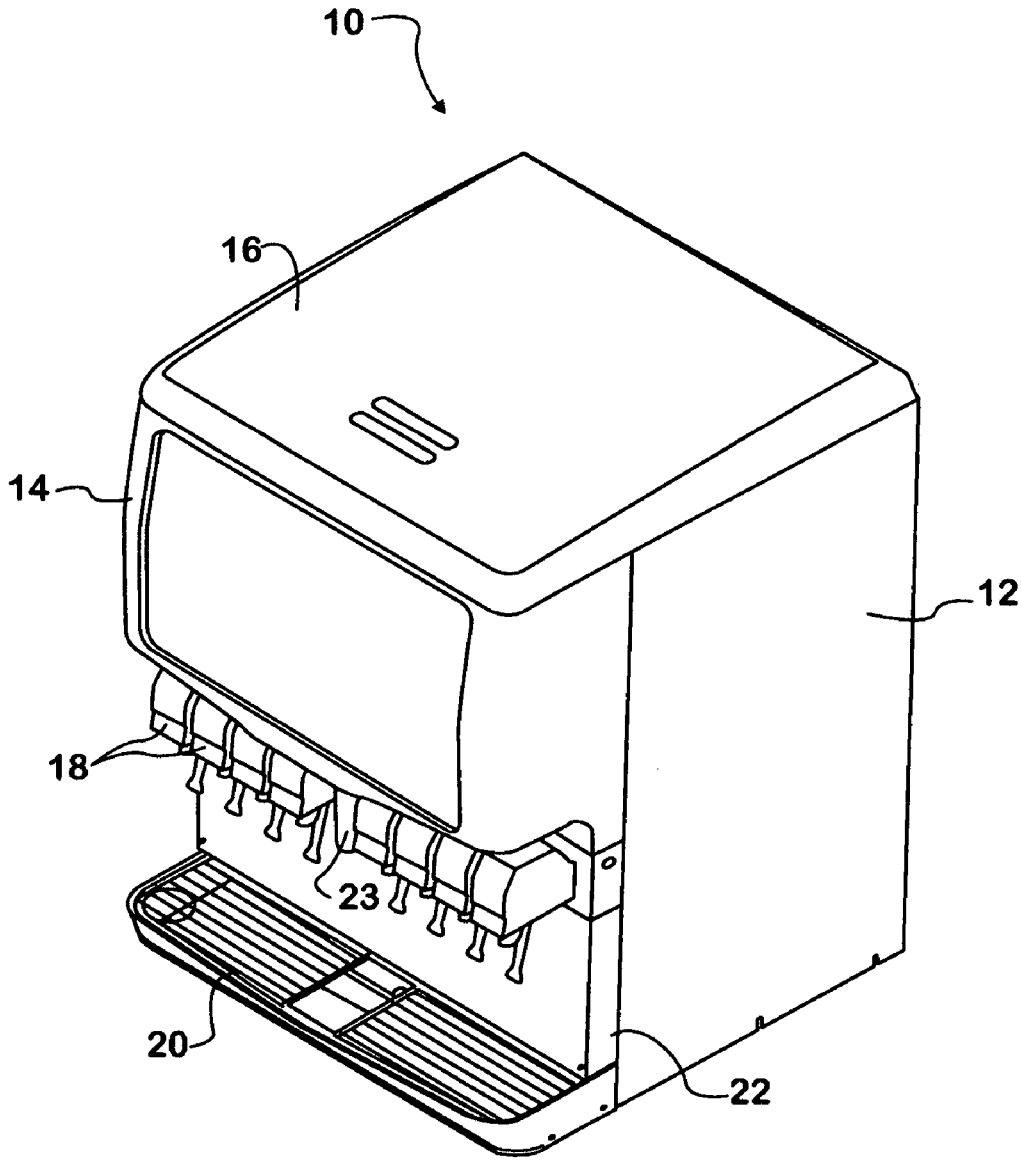
FIG. 1 is a perspective view of an ice and beverage dispenser of a type having a cold plate.

The present invention provides an improved ice/beverage dispensing and product chilling system in which a cold plate of an ice/beverage dispenser is used as a cooling engine for product to be chilled at a remote location or to chill product for delivery to a remote location. The ice/beverage dispenser may be of the general type shown in FIG. 1 and indicated generally at 10, and includes an outer housing 12, a merchandising cover 14 and a removable ice bin filling cover 16. A plurality of post-mix beverage dispensing valves 18 are secured to a front surface of the dispenser 10 above a drip tray 20 and adjacent to a splash panel 22. An ice dispensing chute 23 is also secured to the front surface of the dispenser 10 centrally of the beverage dispensing valves 18 and above the drip tray 20.

Figure 2:
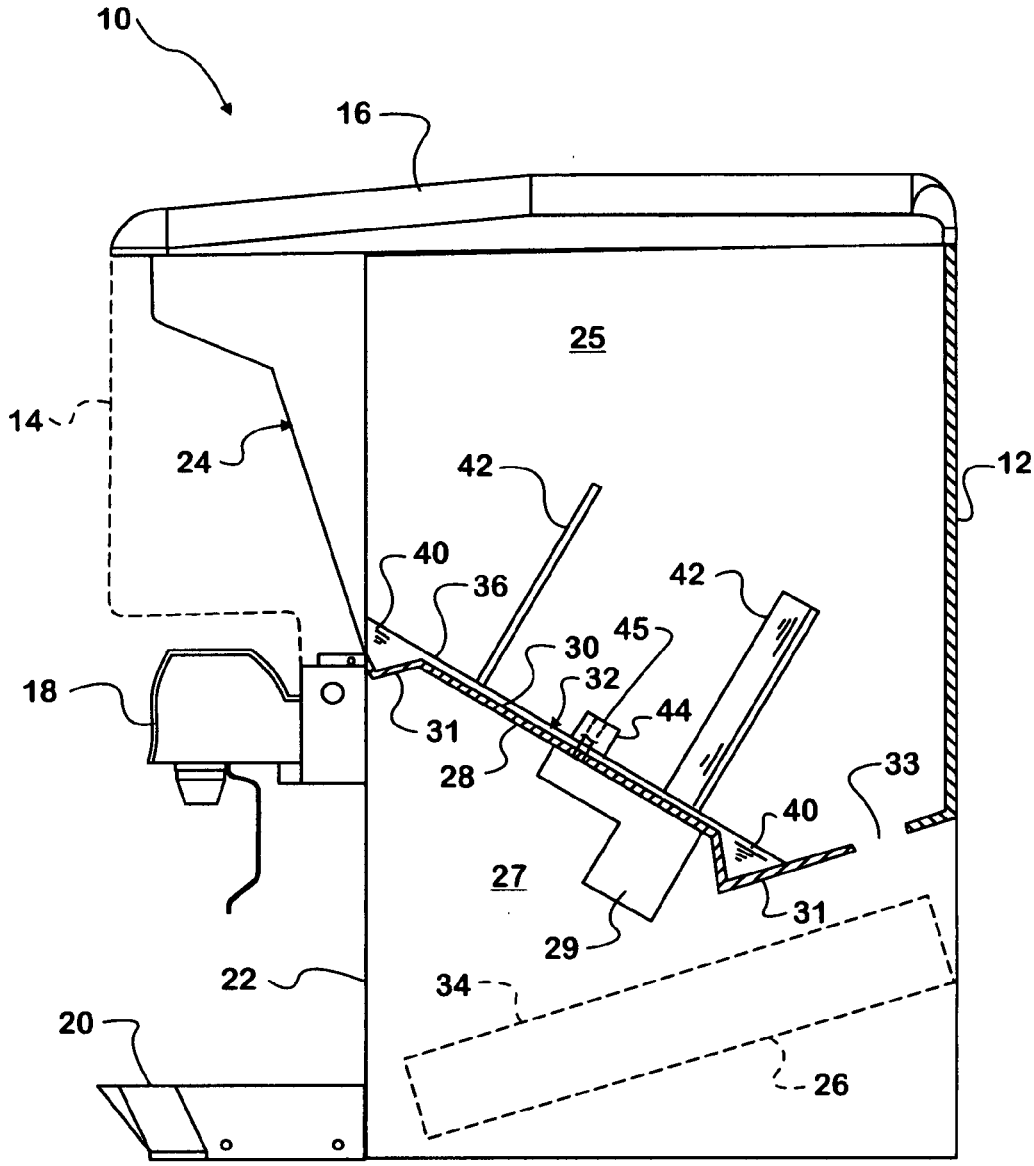
FIG. 2 is a partial cross-sectional side elevation view of the dispenser of FIG. 1.

With reference also to FIG. 2, the ice/beverage dispenser 10 includes an ice hopper or ice bin 24 defining therewithin an ice retaining compartment 25. A cold plate 26 is located in a cold plate compartment 27 beneath the bin 24 and the bin has a wall 28 for mounting on its lower surface an agitator drive motor 29. An upper surface 30 of the wall 28, opposite from the agitator drive motor, is configured to define an annular ice directing trough 31. The drive motor 29 serves to rotate an ice dispense agitator or auger, indicated generally at 32, within the ice retaining compartment 25 of the ice hopper 24. The agitator mixes and agitates ice particles retained within the ice bin 24 to prevent congealing and agglomeration of the ice particles into a mass of ice and to keep the ice particles in free-flowing form, and also serves to move ice particles through the bin trough 31 to and through a forward outlet opening (not shown) from the bin and into an upper end of the ice chute 23 for gravity dispensing of the ice out of a lower end of the chute and into a cup. Rotation of the agitator 32 also causes some of the ice particles retained in the bin 24 to fall through a bottom opening 33 in the wall 28 into the lower cold plate compartment 27 and onto a heat exchange top surface 34 of the cold plate 26. As is understood, the ice cools the cold plate to chill beverage liquids that are flowed through tubing circuits embedded in the cold plate. The agitator has a plurality of radially extending ice sweeping arms 36 at outer ends of which are ice paddles 40 that extend into the bin trough 31 to move ice in the trough to and through the ice outlet from the bin. The agitator also has a plurality of ice agitating blades 42 extending generally perpendicular from the ice sweeping arms 36, as well as a drive bushing 44 for accommodating mounting of the agitator to an agitator motor output shaft 45 for rotation of the agitator in the bin by the agitator motor 29.

According to the present invention, the cold plate 26 of the ice/beverage dispenser 10 is adapted for use as a cooling engine for product to be delivered to or chilled at a remote location. For the purpose, the cold plate is provided with a surplus of cooling capacity, in excess of that required to properly chill beverages served by the dispenser 10 during periods of peak use. This may be accomplished, for example, by having the cold plate be of the multi-layered type and providing the cold plate with extra or auxiliary fluid chilling circuits, so that the total number of fluid chilling circuits of the cold plate exceeds the number normally required by the dispenser 10. To avoid the necessity of changing the cold plate of an ice/beverage dispenser in order to retrofit the dispenser to serve as a cooling engine for other product, it is desirable that in the original manufacture of the dispenser, its cold plate be constructed to provide such excess cooling capacity. If the dispenser is not to serve as a base unit cooling engine for other product, the auxiliary cooling circuit(s) of its cold plate can advantageously be used to provide a surplus of cooling capacity for the dispenser itself that can, for example, improve a carbonation process performed in the dispenser. Should it be desired to retrofit the dispenser to cool other product, the auxiliary cold plate chilling circuit(s) can be converted to that use. Since fluid connections in an ice/beverage dispenser are plumbed, it is contemplated that the dispenser 10 be provided, as initially manufactured, with valve means fluid coupled to its cold plate and easily switchable between a first state in which the auxiliary chilling circuits of the cold plate 26 function to cool beverages served by the dispenser and a second state, used when the cold plate of the dispenser is retrofit to be a cooling engine for other product, in which the auxiliary chilling circuits of the cold plate are used to chill such other product. In this manner, the auxiliary chilling circuits of the cold plate advantageously are at all times used, either to provide a surplus of cooling for the dispenser or to chill other product.

The invention finds use in a variety of applications, in that the transferable chilling feature of the ice/beverage dispenser 10, via use of its cold plate 26 as a cooling engine, can be used to chill any product that requires cooling below ambient and delivery or chilling at a remote location from the dispenser. The dispenser can be adapted for recirculating a primary fluid to a remote location for consumption or a recirculating fluid can be used, via a heat exchange process at a remote location, to chill or maintain cold any product, e.g., perishable food. Among various uses contemplated for the invention are: recirculating cold carbonated water through a manifold for delivery as a carbonated drink; recirculating cold potable water through a manifold for delivery as a non-carbonated beverage; recirculating cold potable water to a heat exchanger/carbonator tank for delivery as a carbonated beverage; recirculating cold potable water through a manifold for delivery at a cold water fountain; recirculating cold water to a heat exchanger/container to cool a dairy products such as milk, cream or butter; recirculating cold water to a heat exchanger/container to maintain a salad bar; and recirculating cold fruit juice through a manifold for delivery as a beverage. These uses are not intended to be exclusive, merely suggestive of the many uses available for the invention.

Reference is made to the schematic representations of systems shown in FIGS. 3-6 for an understanding of the scope and nature of the invention and, generally, of various possible implementations of the invention. An ice/beverage dispenser 10 is employed in each embodiment of FIGS. 3-6 and in each the cold plate 26 of the dispenser is used to chill a fluid recirculated through a closed-loop fluid circuit 46 in the direction shown by arrows. Chilling of the fluid is accomplished by using an auxiliary circuit(s) of the cold plate in the closed-loop fluid circuit and recirculation of the fluid may be provided by a carbonator pump of the dispenser 10 or by a separate pump provided for the purpose.

Figure 3:
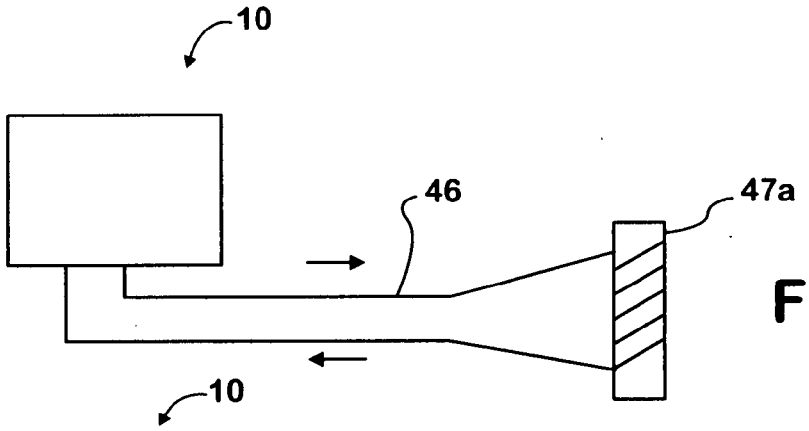
FIGS. 3-6 are schematic representations of apparatus according to the invention, showing various manners of using a cold plate of an ice/beverage dispenser to deliver chilled product to or to chill product at a remote location.

In the system of FIG. 3, the fluid recirculation circuit 46 is coiled around the outside of and in heat exchange contact with a remote product container 47*a*, so that there is a transfer of heat from product in the container to the chilled fluid in the recirculation circuit for cooling of the product. The product may be any suitable product it is desired to cool, whether it is a product that perishes unless cooled or a product the taste quality of which benefits from cooling. The fluid in the circuit 46 may be any suitable fluid that serves a heat transfer function, such as water. The fluid in the circuit 46 may also be the same as the product in the container 47*a*, with the system then including appropriate valves and being arranged to transfer fluid (product) from the circuit 46 to the container 47*a* to refill the container with product if and as necessary.

Figure 4:
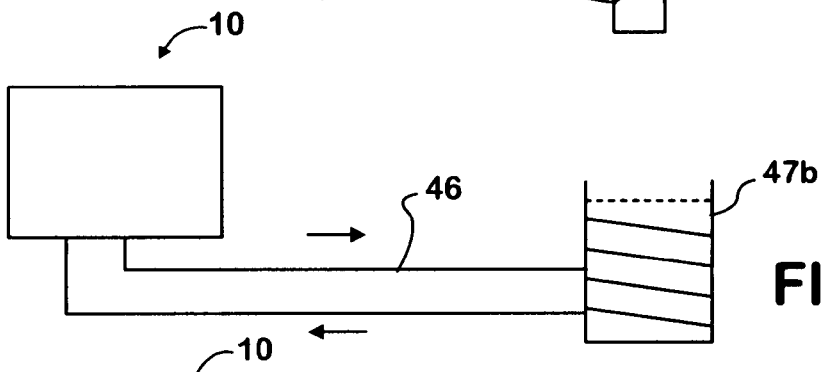

In the system of FIG. 4, the fluid recirculation circuit 46 is coiled within the interior of a remote product container 47*b* in heat exchange contact with product within the container, so that there is a transfer of heat from the product to the chilled fluid in the recirculation circuit for cooling of the product. Alternatively, the container may be filled with a liquid such as water and the product immersed in the water, such that the fluid recirculation circuit chills the water which, in turn, chills the product.

Figure 5:
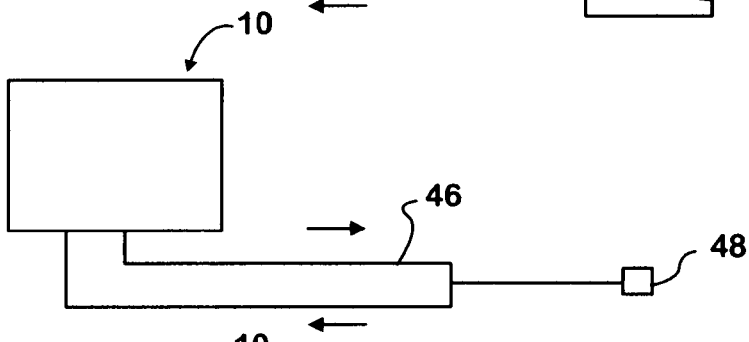

In the system of FIG. 5, the product itself is the fluid that is circulated in the fluid recirculation circuit 46, such that the product is directly cooled upon passage through the cold plate auxiliary chilling circuit(s). In this embodiment, a product server 48 can either be coupled to the recirculating circuit, as shown, or it can be made part of the recirculation loop. The product server may be any suitable mechanism for dispensing the product, depending upon the nature of the product. For example, if the product in the closed-loop recirculation circuit is a beverage, then the product server 48 may be a beverage serving valve.

Figure 6:
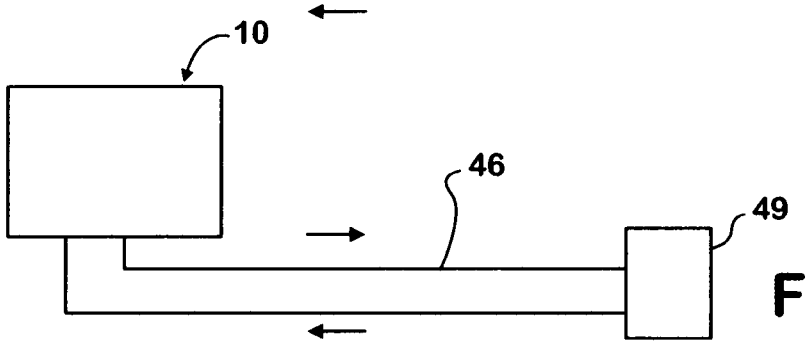

In the system of FIG. 6, the fluid recirculation circuit 46 leads to and passes through the fluid circuits of a remote heat exchanger 49. Thus, in this embodiment the cold plate 26 of the ice/beverage dispenser 10 serves to cool a remote heat exchanger. The heat exchanger 49 can be used in its remote location for any customary purpose, for example to chill a salad bar.

For a better understanding of the invention and to facilitate an appreciation of various types of structures that may be embodied in systems for practicing the invention, the ice/beverage dispenser 10, which is adapted to dispense both ice and carbonated and/or plain water drinks, will be described in greater detail in connection its use in beverage dispensing systems that include a remote beverage dispensing tower. These systems, shown schematically in FIGS. 9-13, are somewhat similar to the system of FIG. 3, but it is to be understood that use of the dispenser 10 to support a remote beverage dispensing tower is not intended to be exhaustive of the various contemplated uses of the invention.

When using a remote beverage dispensing tower, a challenge is to maintain the ability to dispense a cold drink at the remote dispensing location. If the tower experiences periods of idleness or low demand, the temperatures of the fluids in the long interconnecting pythons can warm up to the prevailing ambient temperature, resulting in a warm and unsatisfactory beverage of inferior quality being dispensed.

Figure 9:
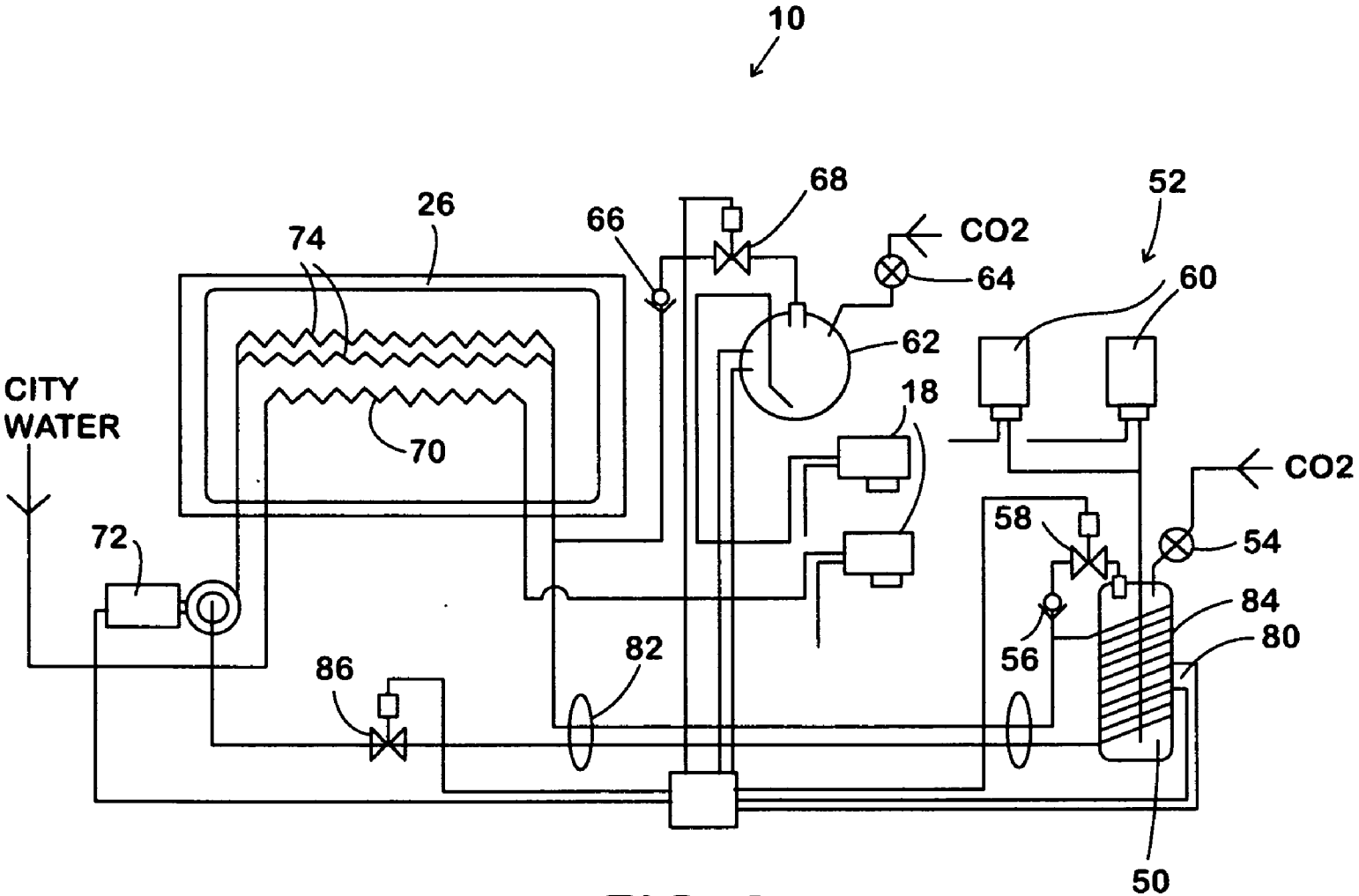
FIG. 9 is a circuit representation of an embodiment of apparatus according to the invention, in which a cold plate of an ice/beverage dispenser is used as a cooling engine for a carbonator tank of a remote beverage dispensing tower.

With reference to FIGS. 7-9, FIG. 9 of which illustrates one arrangement where the ice/beverage dispenser 10 is used to support a remote beverage dispensing tower, the cold plate 26 of dispenser 10 is used as a cooling engine for chilling a remote carbonator tank 50 of the remote tower, indicated generally at 52. The carbonator tank 50 is coupled to a supply of $CO_2$ through a pressure regulator 54 and receives water from the ice/beverage dispenser 10 through a check valve 56 and a solenoid controlled valve 58 to produce carbonated water in a known manner for supply to two post-mix beverage dispensing valves 60 of the tower 52. The ice/beverage dispenser 10 also includes its own carbonator tank 62 that is similarly coupled to a supply of $CO_2$ through a pressure regulator 64 and that receives water through a check valve 66 and a solenoid controlled valve 68 to produce carbonated water for supply to post-mix beverage dispensing valves 18 of the dispenser, only two of which are shown in FIG. 9. Of the two dispensing valves 18 shown, one receives carbonated water from the carbonator 62 while the other receives plain or non-carbonated water from a potable water supply, such as a supply of city water, which is chilled by being flowed through a tubing circuit 70 of the cold plate 26.

To improve the efficiency of the carbonation process and so that cold carbonated water will be available for dispensing into drinks by the ice/beverage dispenser 10, a carbonator pump 72 delivers water to the carbonator 62 through tubing circuits 74 in the cold plate 26 and through the check valve 66 and solenoid controlled valve 68, the pump 72 and valve 68 being under control of and operated by a controller 76. The carbonator 62 has a water level sensor 78 that provides an input to the controller 76, such that the controller operates the carbonator pump 72 and the valve 68 in a manner to maintain desired levels of water in the carbonator 62. So that carbonated water in the carbonator 62 will be and will remain cold for dispensing, the carbonator 62 advantageously is located in the cold plate compartment 27 of the dispenser 10 in heat exchange contact with the cold plate 26.

As is conventional, the remote beverage dispensing tower 52 does not have a cold plate and is not provided with a supply of ice. Therefore, to improve the efficiency of the carbonation process by the remote carbonator 50 and so that cold carbonated water will be available for delivery to the beverage dispensing tower valves 60, the invention contemplates that to refill the carbonator tank 50, the carbonator pump 72 deliver water through the cold plate circuits 74, the check valve 56 and the solenoid controlled valve 58 to an inlet to the carbonator tank 50, with the pump 72 and valve 58 also being under control of and operated by the controller 76. The carbonator 50 includes a water level sensor 80 that provides an input to the controller 76, such that the controller operates the carbonator pump 72 and the valve 58 in a manner to maintain desired levels of water in the carbonator 50. So that carbonated water in the carbonator 50 will be and will remain cold for dispensing, a closed loop cold water recirculation circuit delivers chilled water to and into heat exchange relationship with the carbonator tank. The chilled water is flowed through the closed loop circuit by the carbonator pump 72, and beginning at an outlet from the pump 72, the closed loop water recirculation circuit leads to and passes through the cold plate circuit 74, where the cold plate acts as a cooling engine to chill the water. From the cold plate circuit 74, the recirculation circuit leads through a python 82 to an inlet to a coil of tubing 84 that is wrapped around the exterior of the carbonator tank 50 in intimate heat exchange contact with the tank, so that there is a transfer of heat from the carbonator tank, and therefore from carbonated water in the carbonator tank, to the chilled water flowing through the coil of tubing. From the coil of tubing 84, the closed loop water recirculation circuit returns through the python 82 and a solenoid controlled valve 86 to an inlet to the carbonator pump 72, the valve 86 also being operated by the controller 76. The inlet to the carbonator pump 72 is fluid coupled to the potable water supply, and so that concentrate beverage syrup delivered to the remote tower beverage dispensing valves 60 will be cold, the syrup supply lines are in intimate heat exchange contact with the cold water recirculation circuit.

The controller 76 utilizes three different control schemes, as seen in FIGS. 7 and 8, to operate the solenoid controlled valves 58, 68 and 86 in three different modes that provide three different water flow paths in the circuit of FIG. 9. In a first control scheme that is implemented when neither of the carbonator tanks 50 and 62 requires refilling, the apparatus is in a normal or standby mode in which the carbonator pump 72 is on, the valve 86 is opened and the valves 58 and 68 are closed, so that water chilled in flowing through the cold plate circuit 74 is recirculated through the closed loop and through the coil 84 to chill the remote carbonator tank 50 and the carbonated water in the tank. In a second control scheme that is implemented when the carbonator tank 62 requires refilling, as input to the controller 76 by the water level sensor 78, the carbonator pump 72 is on, the valves 58 and 86 are closed and the valve 68 is opened so that water chilled in flowing through the cold plate circuit 74 is introduced into the carbonator tank 62 until the water level sensor 78 indicates to the controller 76 that the tank is refilled. In a third control scheme that is implemented when the carbonator tank 50 requires refilling, as detected by its water level sensor 80, the carbonator pump 72 is on, the valves 68 and 86 are closed and the valve 58 is opened so that water chilled in flowing through the cold plate circuit 74 is delivered into the carbonator tank 50 until its water level sensor 80 indicates to the controller 76 that the tank is refilled.

The FIG. 9 embodiment of beverage dispensing system uses a single carbonator pump 72 that services two carbonator tanks and doubles as a recirculation pump. In this system, heat is taken up by the cold plate from the water in the closed loop recirculation circuit to chill the water, and the chilled water is then flowed to the coil 84 around the carbonator tank 50 at the remote tower 52, where the water takes up heat from the carbonator tank to chill carbonated water in the tank and maintain the carbonated water at a temperature of no more than about 38° F. The desirable result is that cold carbonated water is always available at the remote post-mix beverage dispense valves 60.

In the FIG. 9 embodiment of beverage dispensing system, it is advantageous to prioritize refilling of the two carbonator tanks 50 and 62. Desirably, the carbonator tanks 50 and 62 are refilled at different times, so that the required water flow through the circuit 74 of the cold plate 26 is as small as possible to optimize chilling of the water. However, that does not always happen, and it is therefore contemplated that the carbonator tank 50 at the remote beverage dispensing tower 50 be larger than the carbonator tank 62 at the ice/beverage dispenser 10 and that priority be given, should both carbonator tanks 50 and 62 require refilling at the same time, to refilling the ice/beverage dispenser carbonator tank 62 first. In other words, even if the water level sensor 80 of the remote tower carbonator tank 50 indicates to the controller 76 that refilling of the carbonator tank 50 is required, if at that time the ice/beverage dispenser carbonator tank 62 requires filling or is being refilled, the carbonator tank 50 will not be refilled until filling of the carbonator tank 62 is completed. The carbonator tank 50 should therefore be of sufficient size or capacity to avoid any "gas out" issues until its refilling can take place.

Figure 10:
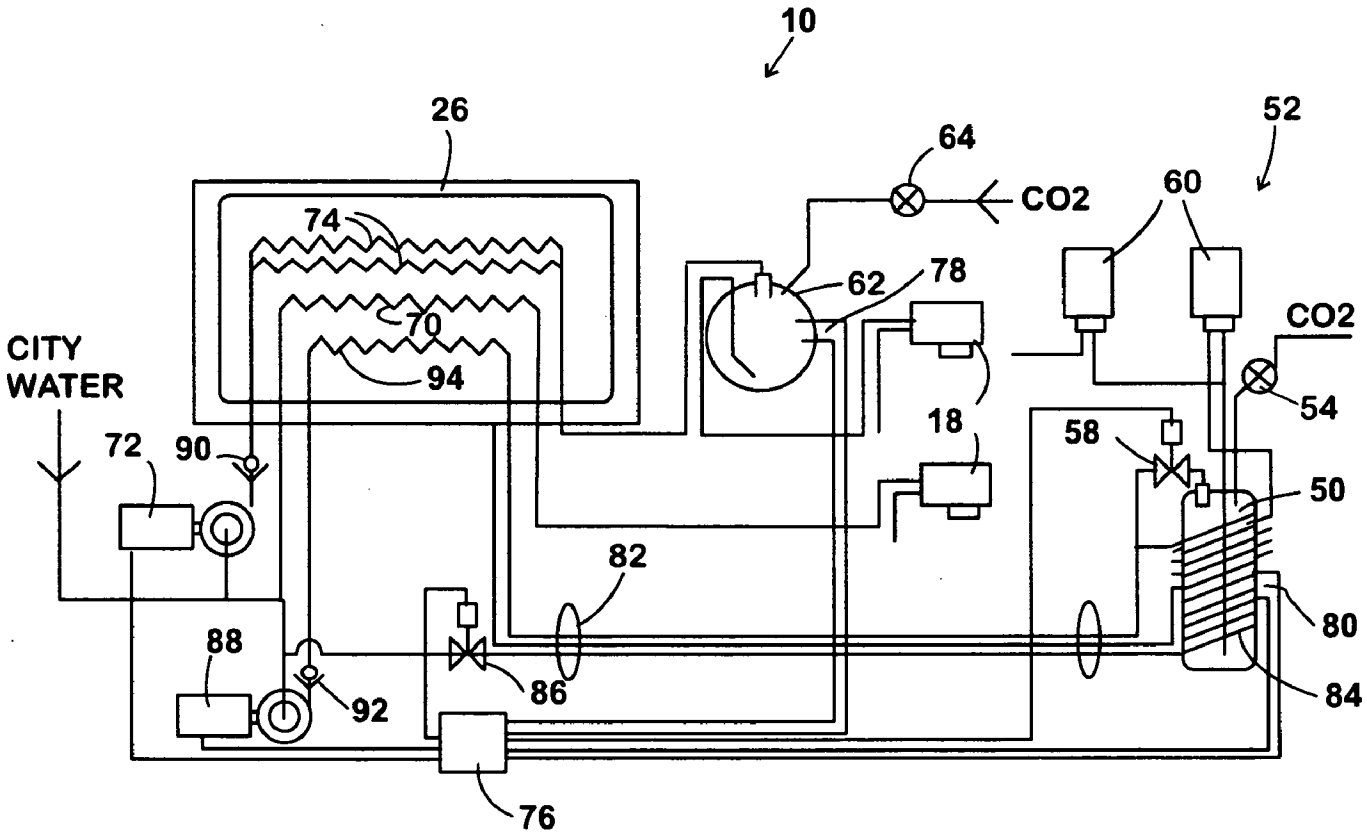
FIG. 10 is a circuit representation of another embodiment of apparatus in which the cold plate of the ice/beverage dispenser is used as a cooling engine for the carbonator tank of the remote beverage dispensing tower.

Referring to the FIG. 10 embodiment where like reference numerals denote like elements, two carbonator pumps are used, the carbonator pump 72 and a carbonator pump 88. The pump 72 is associated with and serves only the carbonator tank 62 of the ice/beverage dispenser 10. In response to signals from the water level sensor 78 of the carbonator tank 62, the carbonator pump is operated by the controller 76 to deliver water through a check valve 90 and the cold plate circuits 74 to refill the tank as necessary. Because the pump 72 only services the carbonator tank 62, it is not necessary to use a solenoid controlled valve, such as the valve 68, in the fluid flow path from the pump to the tank. Carbonated water from the tank 62 is fluid coupled to one of the two illustrated post-mix beverage dispensing valves 18 and the potable water supply, in addition to being fluid coupled to the inlets to each carbonator pump 72 and 88, is fluid coupled to the other dispensing valve 18.

The second carbonator pump 88 serves as a recirculating pump for supplying cold water through a check valve 92, a dedicated cooling circuit 94 of the cold plate 26 and the python 82 to the cooling coil 84 wrapped around and in heat exchange relationship with the carbonator tank 50 of the remote tower 52, which water, after exiting the cooling coil, is returned through the python and the solenoid controlled valve 86 to the inlet to the pump 88. The second carbonator pump 88 has two modes of operation, a standby mode and a carbonator tank refill mode. In the standby mode of the carbonator pump 88, the valve 58 is closed and the valve 86 is opened so that the pump then circulates cooling water through the coil 84 to chill the carbonator tank 50. In the refill mode, the valve 58 is opened and the valve 86 is closed so that the pump 88 then delivers cold water to the inlet to the carbonator tank 50 to refill the tank. Because two pumps are used and each delivers water through separate cold plate circuits, it is not necessary to prioritize refilling of the carbonator tanks 50 and 62, and both tanks can be refilled at the same time.

Figure 11:
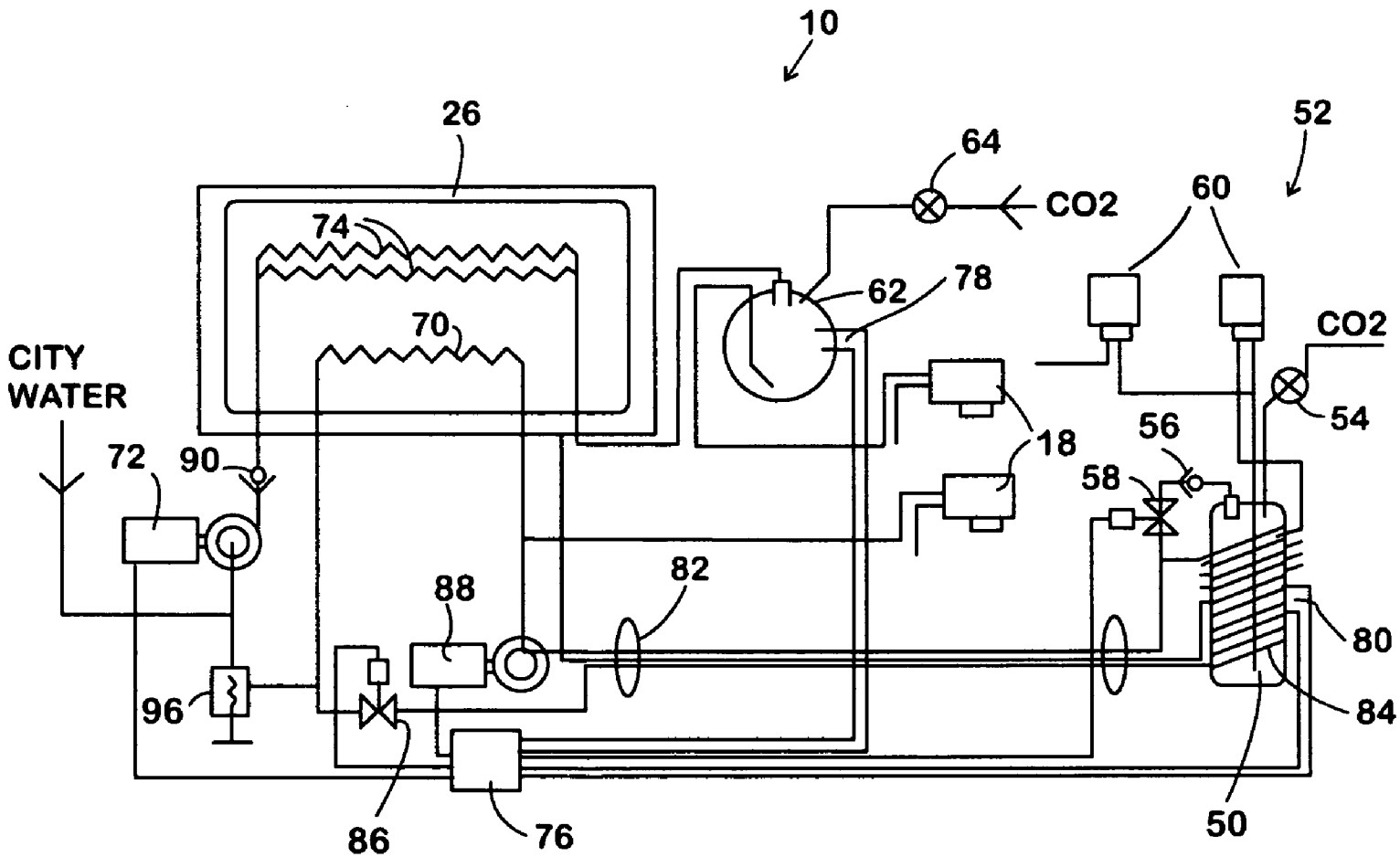
FIG. 11 is a circuit representation of a further embodiment of apparatus in which the cold plate of the ice/beverage dispenser is used as a cooling engine for the carbonator tank of the remote beverage dispensing tower.

Referring now to the FIG. 11 embodiment where like reference numerals have again been used to denote like elements, two carbonator pumps are again used, the carbonator pumps 72 and 88. The first carbonator pump 72 is associated only with the carbonator tank 62 of the ice/beverage dispenser 10 and is operated by the controller 76, in response to an input from the tank water level sensor 78, to deliver water through a check valve 90 and the cold plate circuits 74 to the tank to refill the tank. Because the pump 72 only services the carbonator tank 62, it is not necessary to use a solenoid controlled valve in the fluid flow path from the pump to the tank. Carbonated water from the tank 62 is fluid coupled to one of the two illustrated post-mix beverage dispensing valves 18. The other dispensing valve 18 receives plain water from the potable water supply through a pressure regulator 96 and the cold plate water cooling circuit 70, the potable water supply also being fluid coupled to the inlet to the carbonator pump 72.

In the FIG. 11 embodiment, the second carbonator pump 88 utilizes the plain water cooling circuit 70 of a conventional cold plate, rather than a dedicated circuit, as a result of which this embodiment is adapted to be retrofit to an existing ice/beverage dispenser in the field, with a remote tower application being added as a system upgrade. In a standby mode of operation, the valve 58 is closed and the valve 86 is open, so that the carbonator pump 88 then serves as a recirculating pump for supplying cold water through the python 82 to the cooling coil 84 wrapped around and in heat exchange relationship with the carbonator tank 50 of the remote tower 52, which water, after exiting the cooling coil, returns through the python, the solenoid controlled valve 86 and the cooling circuit 70 in the cold plate 26 to the inlet to the pump 88. In a refill mode of operation, the valve 58 is open and the valve 86 is closed and the pump 88 delivers cold water to the inlet to the carbonator tank 50 to refill the tank until the water level sensor 80 signals the controller 76 that the tank is full. As is the case for the embodiment of FIG. 10, because two pumps are used and each delivers water through a separate cold plate cooling circuit, it is not necessary to prioritize refilling of the carbonator tanks 50 and 62 and both can be refilled at the same time.

While the FIG. 11 embodiment of ice/beverage dispensing system has been illustrated and described as including the solenoid controlled valve 58 for opening and closing the water flow path for refilling the carbonator tank 50, an arrangement of the system is contemplated that does not include the valve 58. In this case, the regulators 54 and 96 are adjusted so that the pressure of $CO_2$ in the carbonator tank 50 is greater than the pressure of the potable water supply delivered to the carbonator pump 88 and provided by the pump at the inlet to the check valve 56 in standby mode of the system. Consequently, in standby mode the check valve 56 is reverse biased and closed to prevent $CO_2$ from exiting the carbonator tank 50, since the pressure of $CO_2$ in the tank is greater than the pressure of water in the recirculation circuit. However, during refill when the valve 86 is closed, the carbonator pump 88 operates to develop a pressure of water at the inlet to the check valve 56 that is greater than the pressure of $CO_2$ in the tank 50, which forward biases and opens the check valve 56 for a flow of water into the carbonator tank to refill the tank.

It would be desirable to be able to quickly, conveniently and efficiently retrofit an existing ice/beverage dispenser, located on a user's premises, to function as a base unit for an associated remote tower, without need for extensive modification of the dispenser and reworking of plumbing. This would enable a user, who already has an ice/beverage dispenser, to economically increase beverage serving capacity and/or the number of different beverages served should the need arise, simply by the addition of a remote tower that is coupled to and served by an existing ice/beverage dispenser, without requiring the user to purchase a new ice/beverage dispenser or incur the costs of extensive retrofitting of the existing dispenser. To facilitate such expansion of beverage serving capability, the invention further contemplates that valves, adapter blocks or conversion modules be included as original parts of an ice/beverage dispenser as manufactured and as delivered to a customer, which adapter blocks would facilitate economical and convenient conversion or retrofit of an ice/beverage dispenser to a base unit the cold plate of which supports a remote beverage dispensing tower. As will be become apparent an adapter block is, functionally, any type of valving arrangement that is switchable between states and, in one state, provides for dedication to the ice/beverage dispenser 10 of all chilling circuits of the cold plate 26 and, in another state, provides for dedication of one or more chilling circuits of the cold plate for use in chilling fluid delivered to a remote location, such as to a remote beverage dispensing tower.

Figure 12:
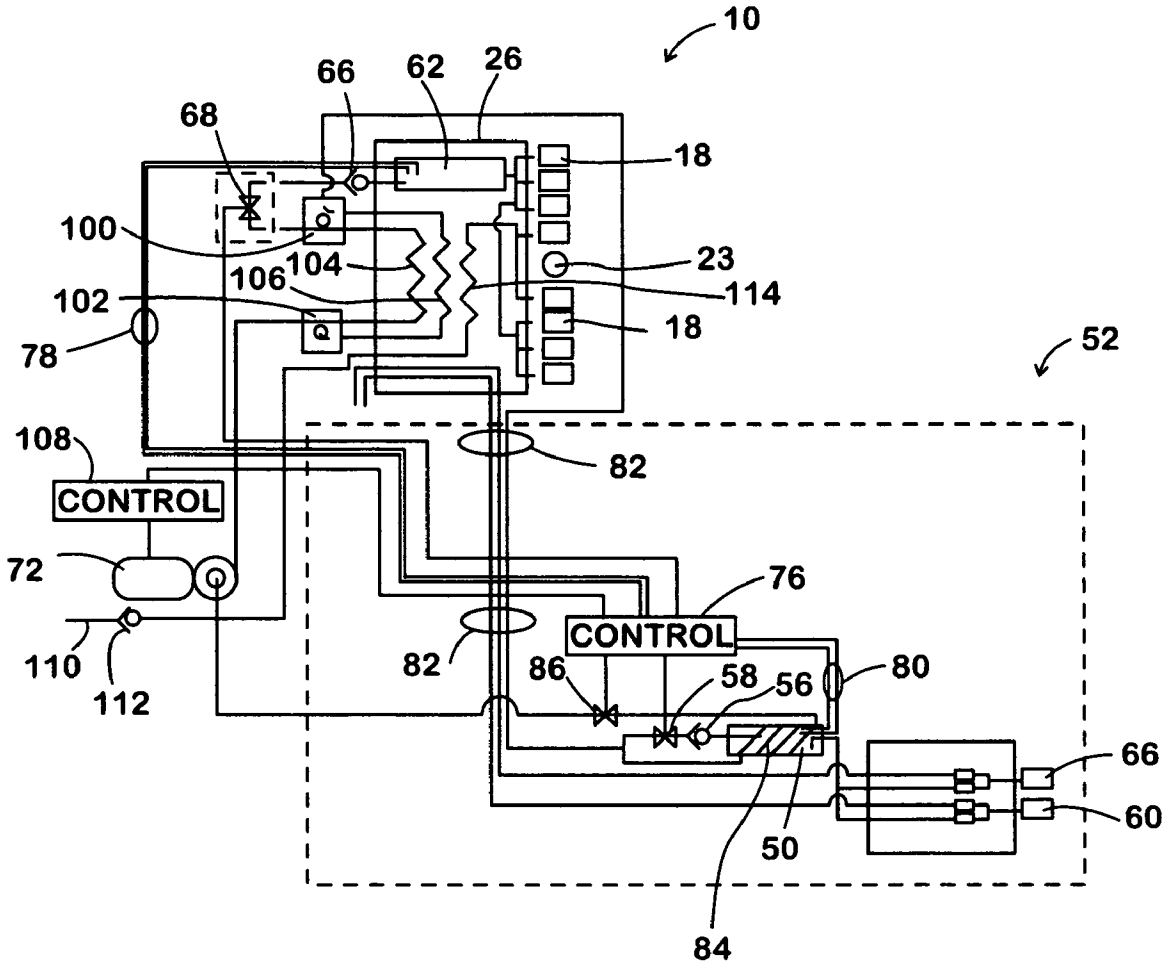
FIG. 12 is a circuit representation of a still embodiment of apparatus in which the cold plate of the ice/beverage dispenser is used as a cooling engine for the carbonator tank of the remote beverage dispensing tower.
Figure 13:
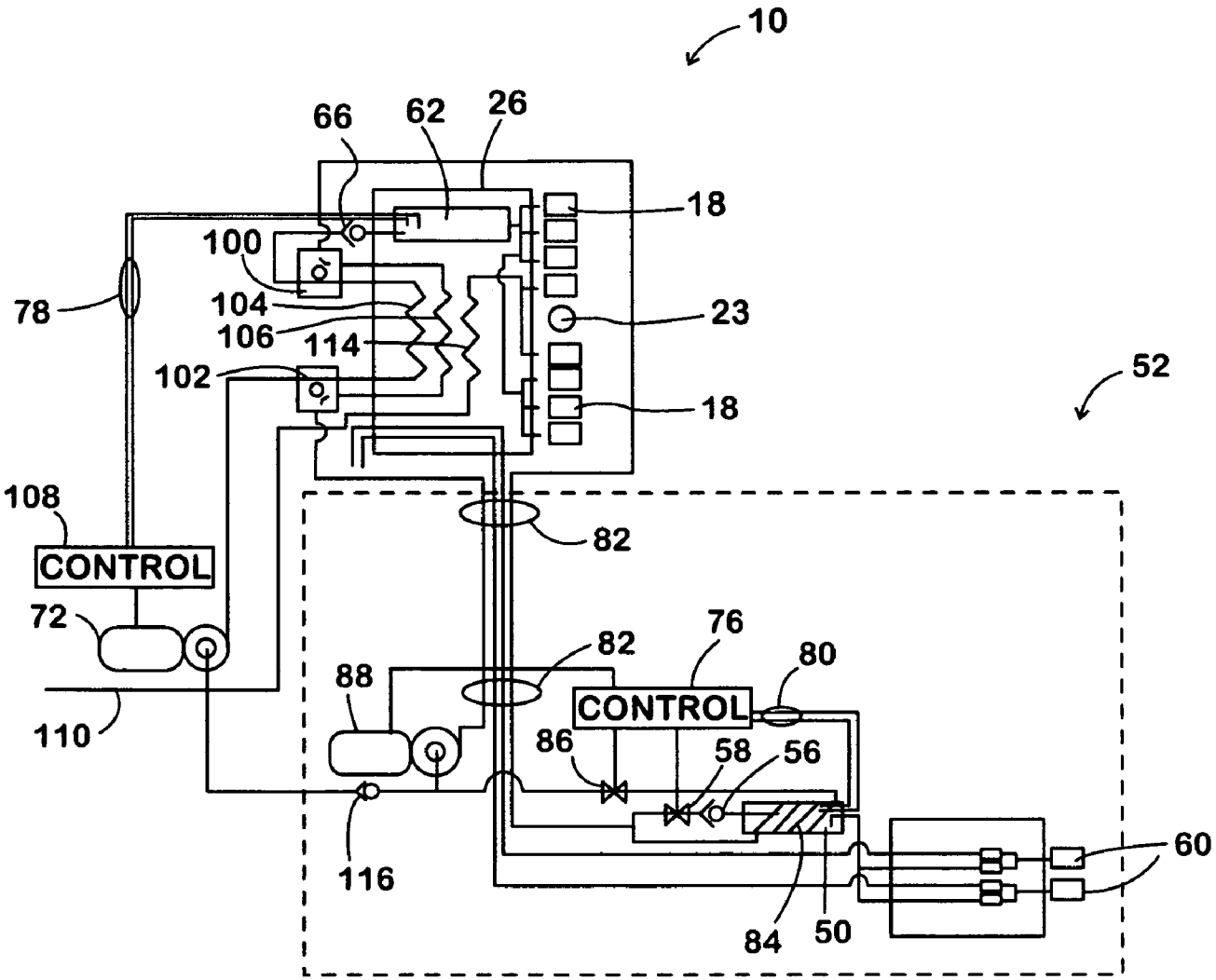
FIG. 13 is a circuit representation of another embodiment of apparatus in which the cold plate of the ice/beverage dispenser is used as a cooling engine for the carbonator tank of the remote beverage dispensing tower.

FIGS. 12 and 13 illustrate two possible arrangements of systems in which adapter blocks are used to heat exchange couple the cold plate 26 of the ice/beverage dispenser 10 to a remote location for providing a chilling function at the remote location, and in particular to heat exchange coupling the cold plate of the dispenser to the carbonator tank 50 of the remote tower 52 to chill the carbonator tank 50. It is to be understood that these two illustrated systems are by no means comprehensive of the types of systems in which adapter blocks may be used to heat exchange couple the cold plate of the dispenser to provide chilling at a remote location, and that other such systems include those of a type shown in FIGS. 3-6 and, for that matter, any type of system in which the chilling effect provided by the ice/dispenser cold plate is delivered to and utilized at a remote location.

In each of the systems of FIGS. 12 and 13, and as for the previously described systems of FIGS. 9-11, coordination of water flow to the base unit carbonator tank 62 and remote tower carbonator tank 50 is provided by a control 76. Also in each, the cold plate 26 of the ice/beverage dispenser 10 advantageously is of a multi-layered design and includes at least one auxiliary chilling circuit that can either be connected in parallel with the at least one chilling circuit for the ice/beverage dispenser carbonator tank 62 to provide a surplus of cooling capacity for the carbonator tank when the dispenser is not used as a base unit coupled to a remote tower, or that can be switched over and dedicated to provide chilled water to the carbonator tank 50 of the remote tower 52 to which the ice/beverage dispenser is to be coupled. Thus, if the need arises to connect the ice/beverage dispenser to a remote tower, the adapter blocks may simply be switched from a first to a second state to provide delivery of chilled water from the base unit cold plate 26 to the remote tower carbonator tank 52 through the auxiliary chilling circuit.

Referring to the FIG. 12 embodiment where again like reference numerals denote like elements, there is shown a system comprising the ice/beverage dispenser 10 serving as a base unit for the remote beverage dispensing tower 52, in which the cold plate 26 of the ice/beverage dispenser is heat exchange coupled through the pylon 82 and a pair of adapter blocks 100 and 102 to the remote tower carbonator tank 50. The remote beverage dispensing tower advantageously is provided in the form of a tower install kit for connection to the dispenser 10 in a retrofit of the dispenser, which dispenser may already and often does separately exist on a user's premises. The tower install kit comprises the components contained within dashed lines and the adapter blocks 100 and 102 are part of the dispenser 10 and may be mounted, for example, on the dispenser cold plate 26 at the time of manufacture of the dispenser. When the ice/beverage dispenser is not used as a base unit for the remote tower, the adapter blocks 100 and 102, which are settable between two states, are set to a first state to provide a flow of water from the dispenser carbonator pump 72 to the dispenser carbonator tank 62 through at least two pre-chill circuits of the dispenser cold plate 26, thereby to provide a surplus of cooling capacity for the water delivered to the carbonator tank. However, upon retrofitting the dispenser 10 to serve as a base unit for the remote tower 52, to provide heat exchange cooling for the remote tower carbonator tank 50, the adapter blocks 100 and 102 are set to a second state to deliver chilled water to the tank 50 through at least one of the at least two cold plate pre-chill circuits that previously served the dispenser carbonator tank 62, so that the base unit carbonator tank 62 then receives water through just pre-chill circuits.

The FIG. 12 embodiment of beverage dispensing system, similar to that of FIG. 9, uses a single carbonator pump 72 to service two carbonator tanks, the tank 50 of the remote tower 52 and the tank 62 of the ice/beverage dispenser or base unit 10, which pump doubles as a recirculation pump providing heat exchange between the dispenser cold plate 26 and tower tank 50. In this embodiment, the pump 72 supplies water to the carbonator tank 62 of the base unit 10 through a first flow path including the adapter block 102, a pre-chill circuit 104 of the cold plate 26 and the adapter block 100, the carbonator tank desirably being mounted in heat exchange contact with the cold plate for enhanced cooling of the tank and its contents. The pump 72 also supplies water through a second flow path comprising a closed-loop recirculation circuit that includes the adapter block 102, a second pre-chill circuit 106 of the cold plate and the adapter block 100. Heat is taken up from the water by the second pre-chill circuit 106 to chill the water and the chilled water exiting the circuit is diverted by the adapter block 100 into the python 82 for flow to the remote tower 52. At the remote tower, the chilled water is flowed through the coil 84 wrapped around and in heat exchange contact with the carbonator tank 50, so that the water takes up heat from the carbonator tank to chill carbonated water in the tank and maintain the water at a temperature of no more than about 38° F. The desirable result is that cold carbonated water is always available at the remote tower post-mix beverage dispense valves 60. The water is then returned from the coil 84 through the python 82 and the solenoid controlled valve 86 to the pump 72 for delivery back through the adapter block 102 and the cold plate pre-chill circuit 106. Alternatively, depending upon signals received by the control 76 from the carbonator tank water level sensors 78 and 80, chilled water delivered to the remote tower 52 by the pump can be directed through the solenoid controlled valve 58 and check valve 56 to refill the carbonator tank 50. For service of non-carbonated drinks, potable plain water from a city water supply 110 is delivered through a check valve 112 and a chilling circuit 114 of the cold plate 26 to a selected one or more of the dispenser post-mix beverage valves 18. Water from the city supply also is coupled to an inlet to the carbonator pump 72.

In the FIG. 12 embodiment, it is advantageous to prioritize refilling of the two carbonator tanks 50 and 62 to ensure that that only one tank is refilled at a time, so that the pressure of water at orifice inlets to the tanks is sufficient for proper atomization of water entering the tanks. Desirably, the carbonator tanks 50 and 62 are refilled at different times, so that sufficient water pressure is not of concern whenever a tank is refilled. However, since that does not always happen, it is contemplated that the remote tower carbonator tank 50 be larger than the base unit carbonator tank 62 and that priority be given, should both carbonator tanks require refilling at the same time, to refilling the base unit carbonator tank 62 first In other words, if the water level sensor 80 of the remote tower carbonator tank 50 indicates to the control 76 that refilling of the carbonator tank 50 is required, and if at the same time the base unit carbonator tank 62 requires refilling as indicated by the water level sensor 78 or is being refilled, the carbonator tank 50 will either not be or will stop being refilled, until completion of refilling of the carbonator tank 62. The carbonator tank 50 is therefore selected to be of sufficient size or capacity to avoid any "gas out" issues until its refilling can take place.

It is noted that the FIG. 12 embodiment includes a second control 108. The control 108 is part of the ice/beverage dispenser 10 as originally manufactured and delivered to a customer, and enables the dispenser to operate as a stand-alone unit. The control 76, on the other hand, is provided as part of the remote tower install kit, the components of which, as mentioned, are those shown within dashed lines. When an ice/beverage dispenser 10 is retrofit with a remote tower install so as to serve as a base unit for a remote tower, the control 76 of the install kit then operates the dispenser pump 72 via the original dispenser control 108.

In the FIG. 13 embodiment of beverage dispensing system, where like reference numerals again denote like elements, two carbonator pumps are provided, the carbonator pump 72 for the ice/beverage dispenser 10 and the carbonator pump 88 for the remote beverage tower 52. Unlike the FIG. 12 embodiment, the pump 72 is associated with and serves only the base unit carbonator tank 62 and is directly operated by the original base unit control 108 to deliver water through the adapter block 102, the cold plate circuit 104, the adapter block 100 and the check valve 66 to refill the tank 62 as necessary. Because the pump 72 only services the base unit carbonator tank 62, it is not necessary to use a solenoid controlled valve, such as the valve 68 (FIG. 12), in the flow path from the pump to the tank. Carbonated water from the tank is fluid coupled to selected ones of the base unit post-mix beverage dispensing valves 18 and the city water supply 110, in addition to being fluid coupled to inlets to each carbonator pump 72 and 88, is coupled through the cold plate circuit 106 to the remaining dispensing valves 18.

In a first one of its functions, the second carbonator pump 88 serves to deliver cold water through the adapter block 102, the cold plate auxiliary cooling circuit 106, the adapter block 100 and the python 82 to the cooling coil 84 wrapped around and in heat exchange contact with the remote tower carbonator tank 50. After exiting the cooling coil, the water returns through the python and solenoid controlled valve 86 to the inlet to the pump 88, with a check valve 116 preventing flow of the water to the pump 72.

In a second one of its functions, the carbonator pump 88 serves to refill the remote tower carbonator tank 50. In the recirculating or standby mode of the pump 88, the valve 58 is closed and the valve 86 is opened, so that the pump then circulates cooling water through the coil 84 to chill the carbonator tank 50 as above described. In the refill mode of the pump 88, the valve 58 is opened and the valve 86 is closed, so that the pump then delivers chilled water to the inlet to the carbonator tank 50 to refill the tank. Because two pumps are used, one for each of the base unit and remote tower carbonator tanks 62 and 50, it is not necessary to prioritize refilling of the tanks to ensure that sufficient water pressure will be available at the orifice inlets to the tanks during refill for proper atomization of water entering the tanks, and both tanks can be refilled at the same time.

Figure 14A:
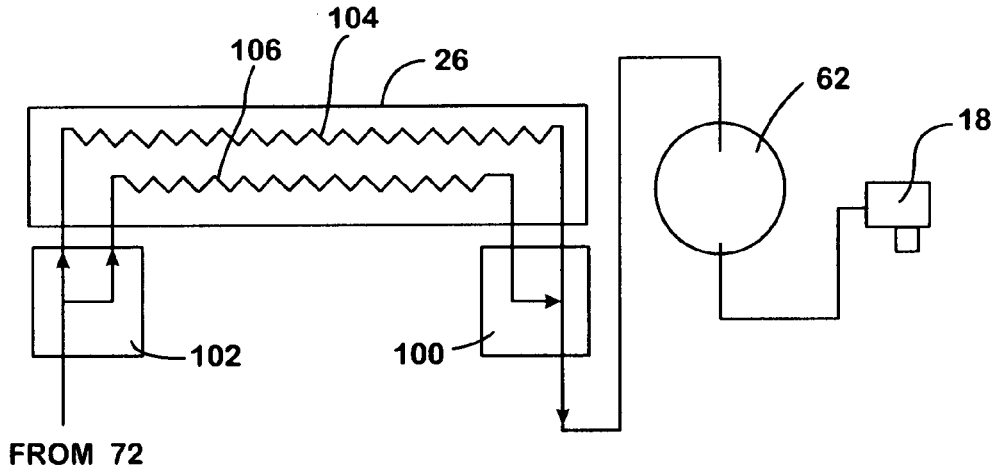
FIG. 14A is a diagrammatic representation showing valves as may be employed to switch the ice/beverage dispenser between use as a stand-alone unit and use as a cooling engine for delivering chilled product to or for chilling product at a remote location, showing the state of the valves for operation of the dispenser as a stand-alone unit.
Figure 14B:
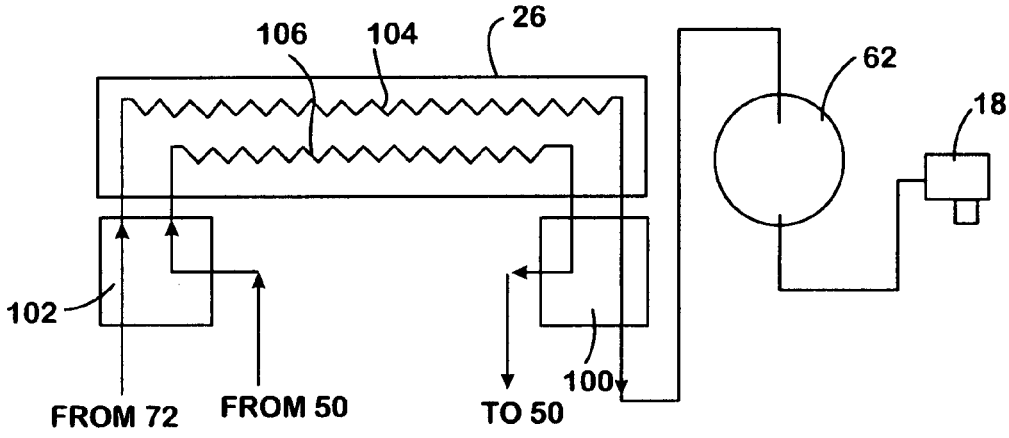
FIG. 14B is similar to FIG. 14A, except that the valves are shown in the state for operation of the dispenser as a cooling engine for delivering chilled product to or for chilling product at a remote location.

FIGS. 14A and 14B diagrammatically illustrate the two states of the adapter blocks or valves 100 and 102. FIG. 14A diagrammatically shows the adapter blocks in their first states, for the circumstance where the ice/beverage dispenser 10 is operating as a stand-alone unit and is not serving as a base unit for the remote tower 52. In this first state of the adapter blocks, water delivered to the adapter block 102 by the dispenser carbonator pump 72 is divided into two flows by the adapter block, one directed through the chilling circuit 104 of the dispenser cold plate 26 and the other directed through the auxiliary chilling circuit 106 of the cold plate. The two flows exiting the chilling circuits 104 and 106 enter the adapter block 100, wherein they are recombined into a single flow directed to the ice/beverage dispenser carbonator tank 62. Since the auxiliary circuit 106 is in excess of the number of circuits normally required for the ice/beverage dispenser 10, and since the carbonator 26, in the absence of the auxiliary chilling circuit 106, would normally receive water flowed through only the chilling circuit 104, the arrangement provides a surplus of cooling capacity for improve carbonation. Consequently, when the dispenser 10 serves as a stand-alone unit, and even if it always serves as a stand-alone unit, the excess cooling capacity provided by the auxiliary chilling circuit 106 is utilized to advantage, so that the capacity of the auxiliary circuit is not wasted. It is to be understood, of course, that while the cold plate has been described as having the chilling circuit 104 dedicated to chilling water for the dispenser carbonator tank 62, and as having the auxiliary chilling circuit 106 for chilling water for either the dispenser carbonator tank in the first state of the adapter blocks 100 and 102 or for the remote tower carbonator tank 50 in the second state of the adapter valves, more than one such dedicated chilling circuit 104 and/or more than one such auxiliary chilling circuit 106 may be provided.

FIG. 14B diagrammatically shows the adapter blocks 100 and 102 in their second states, for the condition where the ice/beverage dispenser 10 is retrofit to serve as a base unit for the remote tower 52. In this second state of the adapter blocks, water delivered to the adapter block 102 by the dispenser carbonator pump 72 is directed by the adapter block only through the dedicated chilling circuit 104 of the dispenser cold plate 26, and upon exiting the chilling circuit the water flows through the adapter block 100 to the dispenser carbonator tank 62. Also in this second state of the adapter blocks, water returning from the remote tower 50 through the recirculation circuit in the python 82 enters the adapter block 102 and is directed by the adapter block into the auxiliary cold plate chilling circuit 104, and upon exiting the circuit is directed by the adapter block 100 back into the python for circulation back to the remote tower. Consequently, when the dispenser 10 serves as a base unit for the remote tower 52, the dispenser carbonator tank 62 receives water delivered only through the dedicated cold plate chilling circuit 104, with the remote tower carbonator tank 50 then receiving water flowed through the auxiliary chilling circuit 106.

From the diagrammatic illustrations of FIGS. 14A and 14B, it can be appreciated that the adapter blocks or valves 100 and 102 can have many different configurations, a criteria being that they selectively provide for heat exchange coupling of at least one chilling circuit of the ice/beverage dispenser cold plate 26 to a remote location to which chilled product is to be delivered or at which product is to be chilled. Such a remote location can be the location of the remote tower 52 and the product to be chilled the water in the tower carbonator tank 50. It is to be understood that in providing such heat exchange coupling, it is not necessary that the dispenser carbonator tank 62 ends up being chilled by fewer cold plate circuits than when the dispenser serves as a stand-alone unit, If desired, auxiliary cold plate chilling circuit(s) can be provided, which normally are unused but that are switched into service to provide heat exchange coupling of the dispenser cold plate 26 to the remote tower 52, even though that would be a waste of surplus chilling capacity when the dispenser is used as a stand-alone unit.

Figure 15:
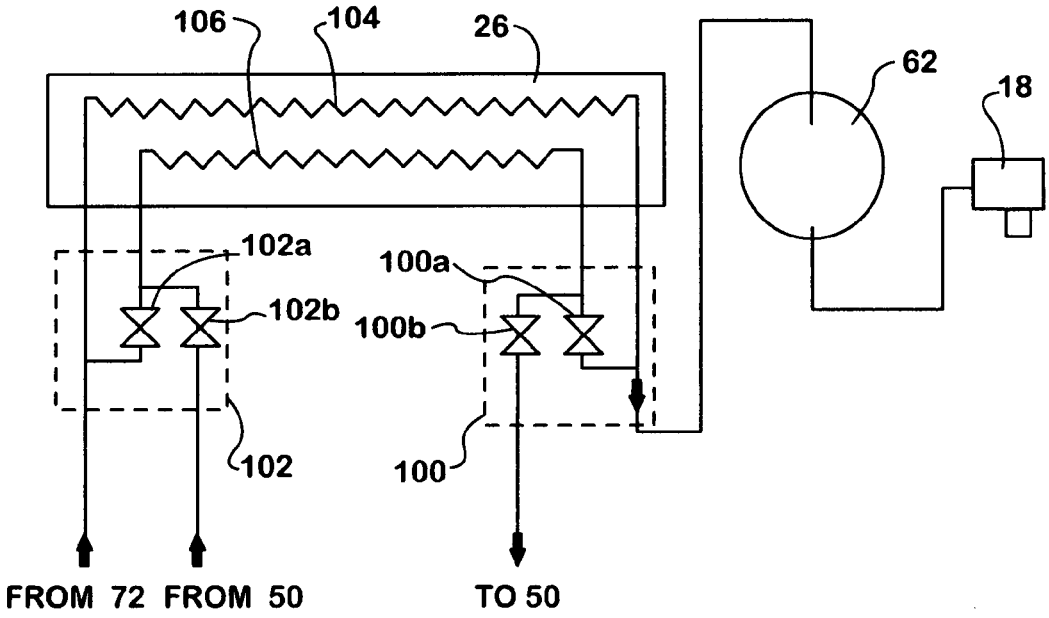
FIG. 15 is a schematic representation of valves as may be employed to switch the ice/beverage dispenser between use as a stand-alone unit and use as a cooling engine for delivering chilled product to or for chilling product at a remote location.

FIG. 15 shows one possible arrangement of valves for accomplishing the foregoing criteria. The valves 100*a* and 100*b* of the adapter block 100, and the valves 102*a* and 102*b* of the adapter block 102, can be any type of valve that can be controlled to serve the function of switching a fluid flow on and off. They can, for example, be gate valves, ball valves, saddle valves, etc., or combinations of the same, as is readily apparent to one skilled in the art. They can also be electrically controlled valves, such as solenoid controlled valves, although for simplicity of structure and reliability, manually controlled valves are preferred since the valves would not normally be switched sufficiently often to make electrical control more desirable than manual.

Figure 16:
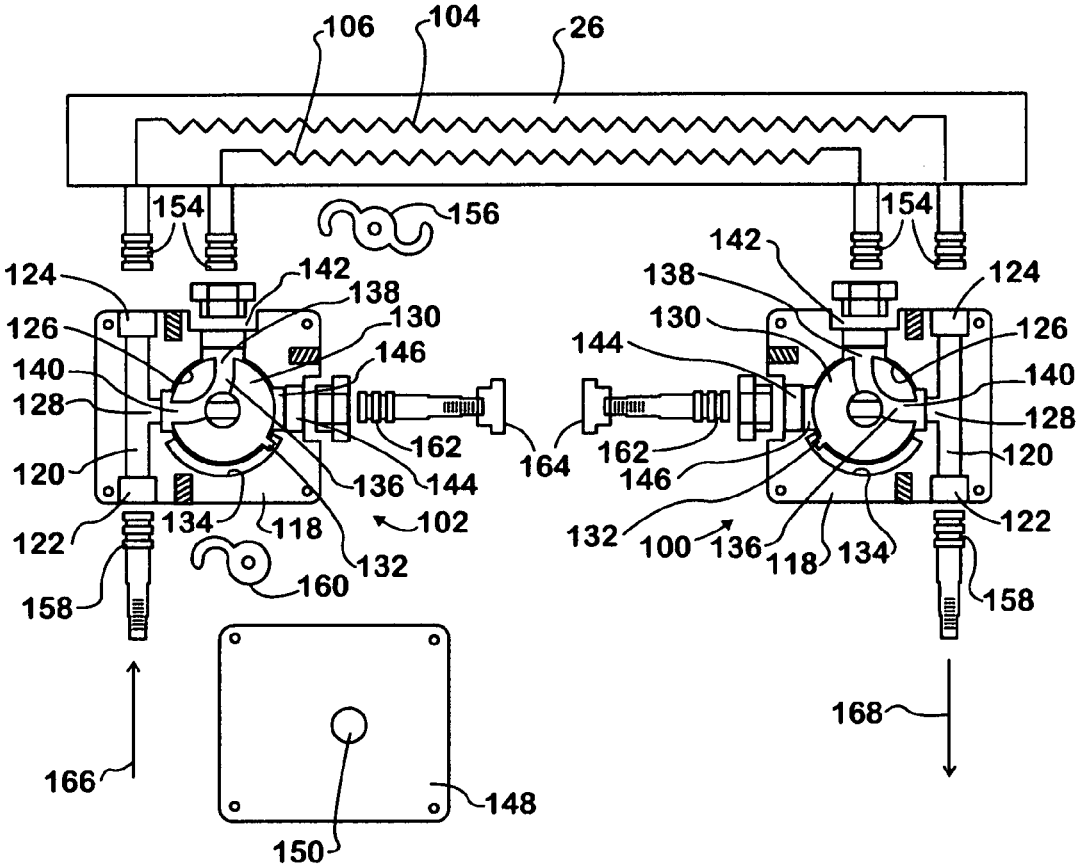
FIG. 16 shows one of various types of valves as may be employed to switch the ice/beverage dispenser between use as a stand-alone unit and use as a cooling engine for delivering chilled product to or for chilling product at a remote location, showing the state of the valves for operation of the dispenser as a stand-alone unit.
Figure 17:
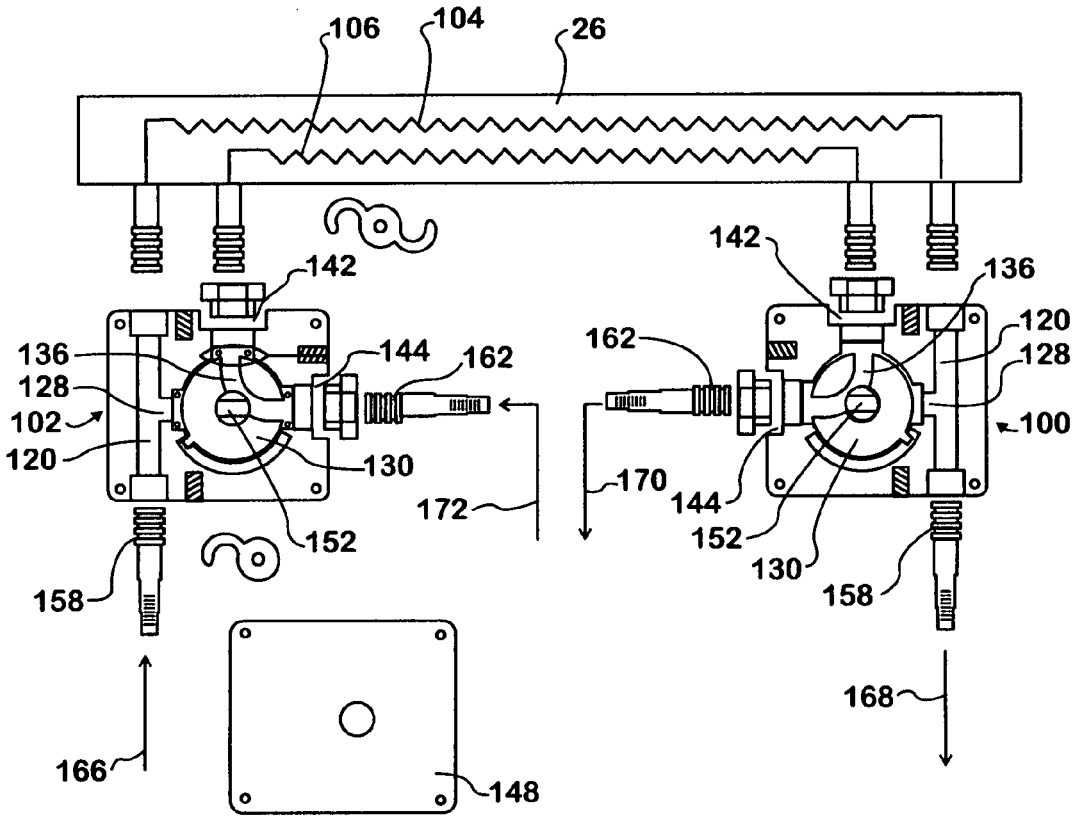
FIG. 17 is similar to FIG. 16, except that the valves are shown in the state for operation of the dispenser as a cooling engine for delivering chilled product to or for chilling product at a remote location.

FIGS. 16 and 17 show one of many possible configurations of the adapter blocks or valves 100 and 102, it being apparent to one skilled in the art that the configuration shown is representative only and that many other configurations and embodiments of valves could be used to perform the same functions. The adapter blocks may be identical and one is shown in front view and the other in rear view. For convenience, the adapter blocks are mounted on the cold plate 26 of the ice/beverage dispenser 10 in fluid communication with the cold plate chilling circuits 104 and 106, although it is not necessary that they be mounted on the cold plate, since they could serve the same function if they were somewhat remote from but fluid coupled to the cold plate. FIG. 16 shows the adapter blocks in their first state when the ice/beverage dispenser 10 is used as a stand-alone unit, i.e., is not being used as a base unit for the remote tower 52. FIG. 17 shows the adapter blocks in their second state when the ice/beverage dispenser serves as a base unit for the remote tower.

Each adapter block 100 and 102 includes a body 118 having a passage 120 with opposite ends 122 and 124. A valve member receiving passage 126 extends generally orthogonal to the plane of the drawing and therefore to the passage 120 and is in fluid communication with the passage 120 through a channel 128. Valve members in the form of rotors 130 are received in the passages 126 and have tabs 132 that extend into radial extensions 134 of the passages. The radial extensions have an arcuate extent on the order of about 90° and define at their opposite ends stops for engaging the tabs upon rotation of the rotors, whereby the rotors are constrained for back and forth rotational movement to an extent generally on the order of 90°. The rotors 130 have arcuate passages 136 with opposite ends 138 and 140, the passages have an extent on the order of about 90° and the bodies 118 have openings 142 and 144 that, together with the channel 128, can communicate with ends of the rotor passages 136 upon rotation of the rotors. The channel 128 and the opening 144 are generally diametrically opposed and the opening 142 is at about 90° with respect to each of the channel 128 and opening 144. O-ring seals 146 in the channels 140 and openings 142 and 144 seal with the rotors 130. Covers 148 close opposite sides of the adapter block bodies 118 and an opening 150 in one cover 148 for each adapter block accommodates outward extension of rotor shafts 152 for manual rotation of the rotors between their two positions 90° apart, which positions define the first and second states of the adapter blocks 100 and 102.

Dole fittings 154 are secured by retainers 156 in the ends 124 of the body passages 120 as well as in the openings 142 to fluid couple the adapter blocks 100 and 102 to and mount the adapter blocks on the ice/beverage dispenser cold plate 26, such that the passage ends 124 are fluid coupled to opposite ends of the cold plate chilling circuit 104 and the openings 142 are fluid coupled to opposite ends of the cold plate chilling circuit 106. Dole fittings 158 are secured by retainers 160 in the ends 122 of the body passages 120 and provide a fluid inlet to the adapter block 102 and a fluid outlet from the adapter block 100. In addition, Dole fittings 162 are secured in the adapter block openings 144 and, for the arrangement shown in FIG. 16 where the adapter blocks or valves are in their first state, have their outer ends closed by caps 164.

The adapter blocks 100 and 102 advantageously are mounted on and fluid coupled to the cold plate 26 of the ice/beverage dispenser 10 as delivered to a customer, irrespective of whether the dispenser, at the time of delivery, is to be immediately coupled to and serve as a base unit for the remote beverage dispensing tower 52. As delivered to a customer, the dispenser is in condition to serve as a stand-alone unit and the inlet Dole fitting 158 to the adapter block 102 is fluid coupled to the outlet from the carbonator pump 72 to receive a flow of water in the direction of an arrow 166 and the outlet Dole fitting 158 from the adapter block 100 is fluid coupled to the carbonator tank 62 to deliver a flow of water to the tank in the direction of an arrow 168.

As mentioned, FIG. 16 shows the states of the adapter blocks 100 and 102 when the ice/beverage dispenser 10 is used as a stand-alone unit and is not coupled to and serving as a base unit for a remote tower. For this first state of the adapter blocks, the valve member or rotor 130 of the adapter block 100 is turned fully clockwise and the valve member or rotor 130 of the adapter block 102 is turned fully counterclockwise, so that in each adapter block the rotor passage 136 is rotated to a first position where it fluid couples the passage 120 to the opening 142. Water delivered from the carbonator pump 72 to the adapter block 102 is therefore divided into two flows in the adapter block, one of which is directed through the adapter block passage 120 into the pre-chilling circuit 104 of the cold plate 26 and the other of which is directed through the rotor passage 136 into the pre-chilling circuit 106. The two flows of chilled water, upon exiting the pre-chilling circuits 104 and 106, then enter the adapter block 100 and are recombined therein into a single flow for delivery from the Dole fitting 158 to the carbonator tank 62. Thus, when the ice/beverage dispenser 10 is used as a stand-alone unit, at least two pre-chilling circuits of the cold plate are used in parallel to provide a surplus of cooling capacity for the dispenser.

FIG. 17 shows the states of the adapter blocks 100 and 102 when the ice/beverage dispenser 10 is used as a base unit for the remote beverage dispensing tower 52, such that the cold plate 26 of the dispenser is used to chill the carbonator tank 50 of the tower. In this case, with the ice/beverage dispenser on a customer's premises and starting with the adapter blocks in their first position or state as shown in FIG. 16, the end caps 164 are removed from the Dole fittings 162, the Dole fitting 162 of the adapter block 100 is fluid coupled to the chilled water delivery circuit of the python 82 leading to the remote tower to deliver a flow of chilled water to the tower in the direction of an arrow 170, and the Dole fitting 162 of the adapter block 102 is fluid coupled to the recirculating water return circuit of the python to receive a flow of water returning from the tower in the direction of an arrow 172. Also in this case, the valve members or rotors 130 of the adapter blocks 100 and 102 are turned to their second states or positions, such that the rotor of the adapter block 100 is turned to its fully counterclockwise position and the rotor of the adapter block 102 is turned to its fully clockwise position. In the second states of the adapter blocks, the rotor passages 136 then extend between and fluid couple the openings 142 and 144, so that the water flow from the ice/beverage dispenser carbonator pump 72 is no longer divided into two streams for flow through both cold plate pre-chilling circuits 104 and 106. Instead, water from the carbonator pump 72 then flows only through the cold plate pre-chilling circuit 104 and the cold plate pre-chilling circuit 106 then receives and chills water delivered to the remote tower 52.

As described, in one state the valves or adapter blocks 100 and 102 fluid couple the ice/beverage dispenser carbonator pump 72 to the dispenser carbonator tank 62 through the cold plate fluid chilling circuit 104 and place the cold plate auxiliary fluid chilling circuit 106 in-line with the closed-loop fluid recirculation circuit including the python 82. Then, in another state the adapter blocks continue to fluid couple the carbonator pump 72 to the carbonator tank 62 through the fluid chilling circuit 104, remove the auxiliary fluid chilling circuit 106 from being in-line with the closed-loop recirculation circuit of the python 82, and place the auxiliary fluid chilling circuit 106 in parallel with the fluid chilling circuit 104 and therefore imine between the carbonator pump 72 and carbonator tank 62. Since in each of their states the adapter blocks 100 and 102 fluid couple the carbonator pump 72 to the carbonator tank 62 through the cold plate fluid chilling circuit 104, it is not necessary that this particular fluid coupling be provided through the adapter blocks. The invention therefore further contemplates that the outlet from the carbonator pump 72 be plumbed to fluid connect through the cold plate fluid chilling circuit 104 to the inlet to the carbonator tank 62 without use of the adapter blocks 100 and 102, and that valves or adapter blocks then be used to either place the cold plate auxiliary fluid chilling circuit 106 in-line with the closed-loop fluid recirculation circuit of the python 82 or to place the auxiliary chilling circuit in parallel with the fluid chilling circuit 104 and thereby in line-between the carbonator pump 72 and carbonator tank 62. A disadvantage of this latter arrangement, a design for which would be readily apparent to those skilled in the art, is that additional hard plumbing would be required, which more conveniently could be provided by the adapter blocks. Also, if the adapter blocks in this latter arrangement are mounted directly on the cold plate, the mounting would be less secure, since each adapter block would then be coupled to only one inlet/outlet of the cold plate, instead of to two.

Figure 18:
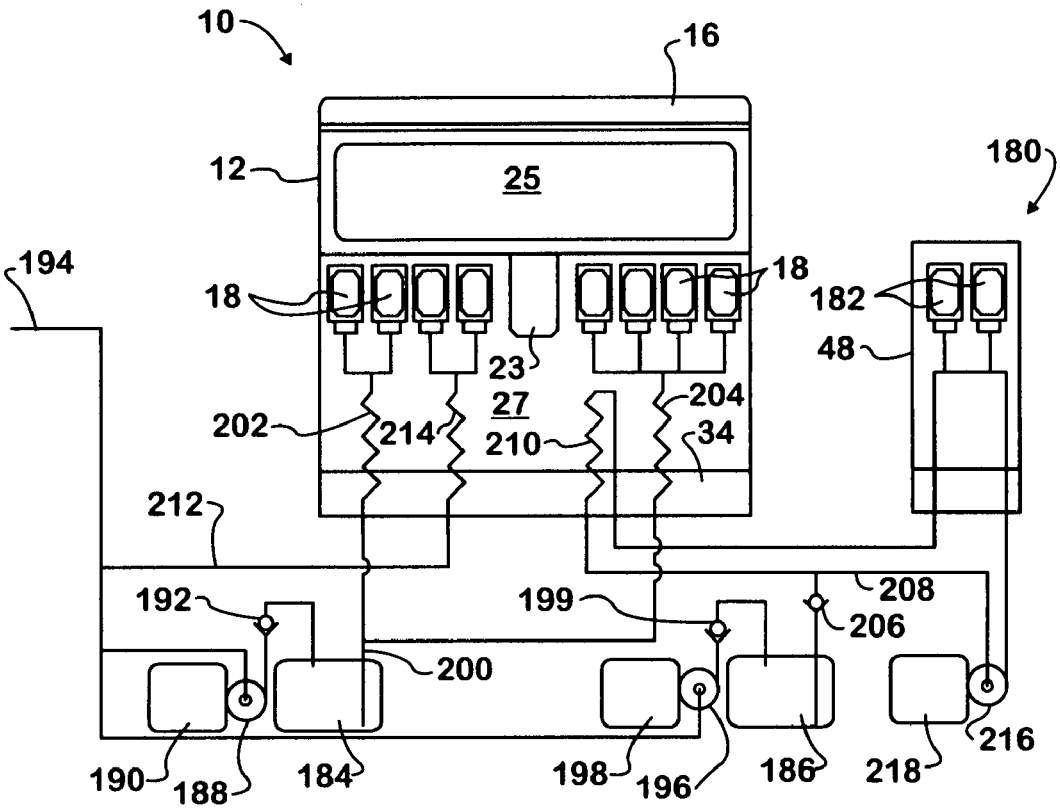
FIG. 18 is a schematic representation of a further embodiment of apparatus according to the invention, showing use of a cold plate of an ice/beverage dispenser to deliver chilled product to or to chill product at a remote location.

FIG. 18 schematically represents a combination of the ice/beverage dispenser 10 and a remote beverage dispensing tower, indicated generally at 180, as may be used in practice of a further embodiment of the invention that contemplates always maintaining a supply of ice on the upper heat exchange surface of the cold plate 34. The remote tower 180 has a plurality post-mix beverage dispensing valves 182 and a separate carbonator tank is provided for each of the ice/beverage dispenser 10 and tower, a carbonator tank 184 for the ice/beverage dispenser and a carbonator tank 186 for the tower. While not specifically shown, the carbonator tank 184 advantageously may be mounted in heat exchange relationship with the ice/beverage dispenser cold plate 34 and water in the remote tower carbonator tank 186 may be chilled in a manner as previously described. The carbonator tank 184 is serviced by a carbonator pump 188 driven by a carbonator motor 190 to introduce into the carbonator tank, through a check valve 192, potable water from a water line 194 that may be a city water supply. The carbonator tank 186, in turn, is serviced by a carbonator pump 196 driven by a carbonator motor 198 to deliver water from the line 194 into the carbonator tank through a check valve 199. As is understood, the carbonator motors 190 and 198 are energized to refill their associated carbonator tanks 184 and 186 in response to sensors (not shown) in the tanks detecting withdrawal of sufficient carbonated water to require refilling. A supply of carbon dioxide gas (also not shown) is connected to each carbonator tank for carbonating water introduced into the tank.

The carbonator tank 184 provides carbonated water to some of the ice/beverage dispenser post-mix valves 18 through a delivery line 200 that includes fluid chilling circuits 202 and 204 of the cold plate 34. The carbonator tank 186, in turn, provides carbonated water to the remote tower post-mix valves 182 through a check valve 206 and a carbonated water delivery line 208 that includes a fluid chilling circuit 210 of the cold plate. All of the post-mix valves need not necessarily receive carbonated water, and in the embodiment shown plain water is supplied to two of the ice/beverage dispenser valves 18 through a delivery line 212 that includes a cold plate fluid chilling circuit 214.

The line 208 for delivering carbonated water from the carbonator tank 186 to the remote tower post-mix valves 182 defines a closed loop fluid convening circuit with circulation being provided by a pump 216 driven by a motor 218. It is understood, however, that while in this embodiment a separate pump 216 and motor 218 provide circulation of carbonated through the line 208, use of such separate motor and pump is not necessary and circulation can be provided using any of the techniques employed in previously described embodiments of beverage dispensing systems. For example, carbonated water in the line 208 could be circulated by the ice/beverage dispenser carbonator motor and pump 190 and 188, or by the remote tower carbonator motor 198 and pump 196, along with appropriate valving.

Whenever a beverage is drawn from the ice/beverage dispenser 10 or remote tower 180, the dispenser cold plate 34 is loaded as a result of warm beverage components flowing through its chilling circuits. As is conventional, an attempt is made to maintain cold plate performance by agitation of ice in the ice retaining compartment 25 of ice/beverage dispenser hopper 24 to cause ice pieces to pass through the lower hopper opening 33 into the underlying cold plate compartment 27 and onto the upper heat exchange surface of the cold plate 34. Such agitation customarily occurs in response to two events: 1) when ice is dispensed from the hopper 24 through the ice chute 23, with agitation moving ice pieces to and through the hopper ice outlet opening and into the ice chute for dispensing into a cup, and also moving ice through the hopper lower opening 33 into the cold plate compartment 27; and 2) periodically at selected intervals as determined by a timer, so that when the dispenser 10 is idle for a extended period the mass of ice in the hopper is prevented from agglomerating and congealing into a lump. Consequently, when a drink is drawn from the dispenser 10, even though warm beverage components flow through the cold plate fluid chilling circuits, which load the cold plate and result in melting of ice on the heat exchange surface of the cold plate, since a drink dispense at the dispenser is usually accompanied by an ice dispense from the dispenser into a cup, agitation of ice occurs to replace cold plate ice consumed incident to the drink dispense. However, agitation of ice does not necessarily occur when drinks are dispensed from the remote tower 180, with the result that the dispensing of drinks from the tower can overload the cold plate 34 and result in an absence of ice on it heat exchange surface.

When the ice/beverage dispenser 10 is combined with and serves as a base unit for the remote tower 180, agitation of ice in the dispenser hopper 24 may not occur sufficiently often to replenish ice that melts on the cold plate heat exchange upper surface when the cold plate is loaded by warm beverage components flowing through it incident to drawing drinks at the tower. This undesirable situation can occur because cups filled with beverage at the remote tower 180 do not necessarily receive ice from the ice/beverage dispenser 10, and therefore do not trigger an ice agitation event, but instead can be filled with ice from a separate supply located by the remote tower. Consequently, if for an extended period drinks are drawn from the remote tower into cups filled with ice from a separate supply of ice, and if during that period ice agitation and replenishment of ice on the cold plate heat exchange surface do not occur because the ice/beverage dispenser is idle, it is possible that the cold plate 34 will become overloaded in the area of the water chilling circuit 210 that serves the tower, resulting in melting of ice and no ice coverage on the cold plate in that area.

To prevent overloading of the cold plate 34 in the area of the fluid chilling circuit 210 that serves the remote tower 180, the invention contemplates sensing when drinks are drawn from tower and operating the ice/beverage dispenser agitator motor 29 in response to one or more drinks being drawn. One contemplated way to sense the dispensing of drinks at the tower is by detecting energization of the remote tower carbonator pump motor 198 to deliver replacement water into the tower carbonator tank 184, which occurs upon a sufficient decrease in the level of water in the tank following the dispensing one or more beverages from the tower. Upon occurrence of energization of the pump motor 198, the agitator motor 29 is energized for a predetermined time to rotate the agitator 32 and cause some of the ice pieces in the hopper 24 to pass downward through the hopper lower opening 33 into the underlying cold plate compartment 27 to maintain a supply of ice in contact with the entirety of the heat exchange upper surface of the cold plate 34, including the area of the surface in proximity to the remote tower carbonated water chilling circuit 210.

Figure 19:
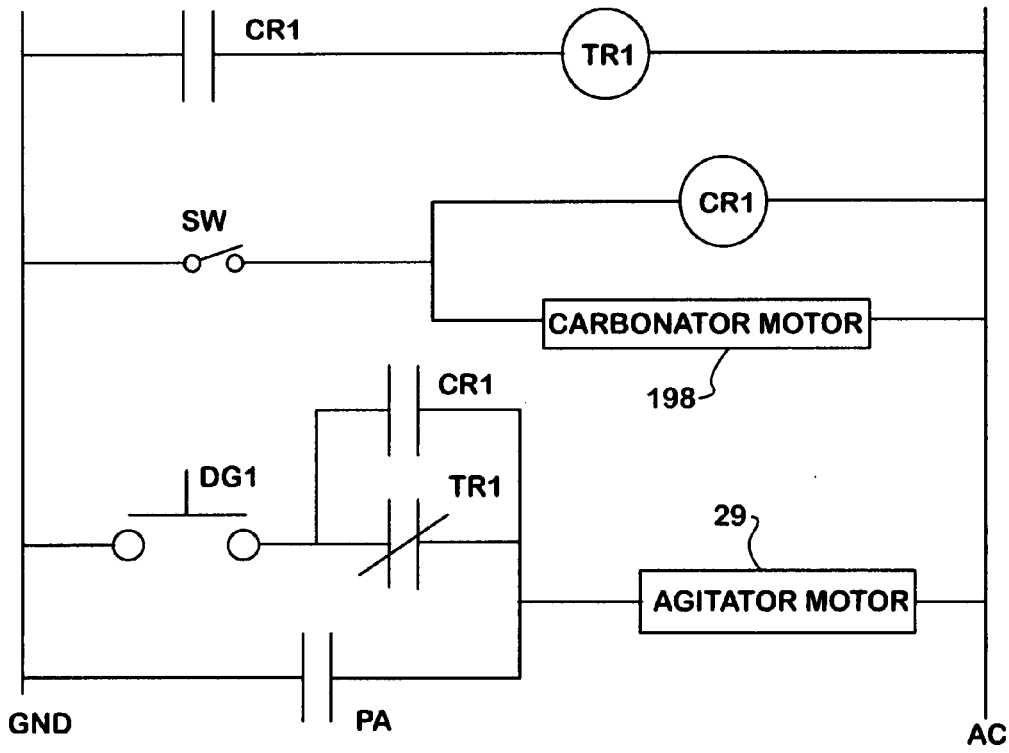
FIG. 19 is one contemplated type of control circuit as may be used to operate the apparatus of FIG. 18.

Timed energization of the agitator motor 29, in response to drinks dispense at the remote tower 180, may be implemented in various ways, as is readily apparent to one skilled in the art. One way, as mentioned above, is to sense the dispensing of drinks at the remote tower 180 by detecting energization of the remote tower carbonator motor 198, which may be accomplished, for example, through use of a circuit of a type as the one shown in FIG. 19. In this circuit, a coil of a relay CR1 is connected across the carbonator motor 198, and an ice agitator board, shown as a coil of a relay TR1, is in series with a normally open contact CR1 of the relay coil CR1. When the sensed level of water in the remote tower carbonator tank 186 drops sufficiently, a water level sensing switch SW closes and connects AC line voltage across the carbonator pump motor 198 to energize the motor. Line voltage applied across the motor 198 also is applied across and energizes the relay coil CR1, causing the relay coil to close its two normally open contacts CR1, which energizes the relay coil TR1 and causes it to open its normally closed contact TR1. When the relay contacts CR1 close and power is applied to the relay coil (agitator board) TR1, by design of the agitator board the agitator motor 29 is immediately run for about 3 seconds. Once the remote tower carbonator pump 198 has refilled the carbonator tank 186 with water, the switch SW again opens and removes line voltage from across the carbonator pump and relay coil CR1, so that the pump stops running and the relay coils CR1 and TR1 are deenergized. By virtue of one of the contacts of the coil CR1 and the contact of the coil TR1 being in parallel with each other and in series with both a dispense gate switch DG1 and the agitator motor 29, one of which contacts CR1 and TR1 is always closed, the agitator motor is always enabled to run when the switch DG1 closes during ice dispense at the ice/beverage dispenser 10, even if at the time of ice dispense the remote tower carbonator motor 198 is energized. This agitation cycle, that is caused to occur in response to energizing the carbonator motor 198 serves, along with the other two above-mentioned customary agitation cycles, to deliver ice to and replenish ice on the cold plate sufficiently often to compensate for increased ice consumption by the cold plate as results from the heat load applied to the cold plate via the remote tower cold plate chilling circuit 210. To provide for the above mentioned agitation cycle that conventionally occurs periodically, a normally open periodic agitation contact PA is in series with the agitator motor 29 across line voltage and is periodically closed for a selected time.

In essence, (1) the agitator motor 29 is activated either by closing of the ice dispense switch DG1 when the ice gate opens to dispense ice from the ice/beverage dispenser 10 into a cup or by closing of the normally-open contact PA for off-cycle agitations at time intervals set by a user/(2) the agitator board TR1 has a built-in feature that provides a timed agitation every time the agitator board is powered up; (3) an ice agitation to replenish ice on the cold plate 34 is initiated every time the carbonator motor 198 is energized in response to a sensed low level of water in the carbonator tank 186; and (4) during times when the carbonator motor 198 is energized to refill the carbonator tank, dispensing of ice and attendant agitation of ice in the hopper are accommodated.

It is understood that other techniques can be used to sense the drawing of drinks at the remote tower in order to initiate an ice agitation event at the ice/beverage dispenser. For example, for the case where there is no separate carbonator pump for the remote tower, as in FIG. 9, or even if there is a separate carbonator pump for the tower, drinks dispense at the tower can be determined by the actuation of a tower beverage valve 180, such as by closure of a switch upon actuation of a beverage valve or by use of a fluid flow sensor in a beverage component supply line to the valve.

The invention therefore advantageously provides flexibility for use of the cold plate in the ice/beverage dispenser 10, in that when the dispenser is used as a stand-alone unit, two or more cold plate circuits may be used to provide a surplus of cooling for water delivered to the dispenser carbonator tank to improve the carbonation process and better ensure that cold drinks will be served. However, should the need arise, the ability to conveniently use the dispenser to deliver chilled product to or to chill product at a remote location is readily available, which adds value to ice/beverage dispenser delivered to customers. Additional value resides in the ability, by virtue of the auxiliary cold plate chilling circuit(s), to expand the variety or quantity of drinks available without need to invest in a new ice/beverage dispenser (base unit) constructed for the purpose. Also, the plug-and-play feature of the valves or adapter blocks coupled to the cold plate makes switchover fast and easy when expanding use of the ice/beverage dispenser to support delivery of a chilled product to or chilling of a product at a remote location. At the same time, cold plate performance is ensured during periods when the ice/beverage dispenser is idle but drinks are being dispensed at the remote tower, by providing for ice agitation in response to the drawing of drinks at the tower.

While embodiments of the invention have been described in detail, various modifications and other embodiments thereof may be devised by one skilled in the art without departing from the spirit and scope of the invention, as defined in the appended claims.

What is claimed is:

1. A method of providing chilling at a location remote from a beverage dispenser having a cold plate with a plurality of fluid chilling circuits, said method comprising the steps of:

flowing fluid through at least one of the cold plate fluid chilling circuits to chill the fluid;

delivering the chilled fluid to the location remote from the beverage dispenser; and heat exchange coupling the chilled fluid to product at the remote location without contact between the chilled fluid and product.

2. A method as in claim 1, wherein the beverage dispenser is an ice and beverage dispenser, and including the step of using ice to chill the cold plate of the dispenser.

3. A method as in claim 1, wherein the beverage dispenser includes a pump and said delivering step comprises using the pump to deliver the chilled fluid to the location remote from the beverage dispenser.

4. A method as in claim 1, wherein the beverage dispenser includes a first pump and said delivering step comprises using a second pump to deliver the chilled fluid to the location remote from the beverage dispenser.

5. A method as in claim 1, wherein product is in a container at the remote location, and including the step of heat exchange coupling the chilled fluid delivered to the remote location to the container.

6. A method as in claim 1, wherein product is in a container at the remote location, and including the step of heat exchange coupling the chilled fluid delivered to the remote location to the product in the container.

7. A method as in claim 1, wherein product is in contact with a heat exchanger, having at least one fluid circuit, at the remote location, and including the step of flowing the chilled fluid delivered to the remote location through the at least one fluid circuit of the heat exchanger at the remote location.

8. A method as in claim 1, wherein a product dispenser is at the remote location, and including the step of operating the product dispenser for dispensing product chilled by the chilled fluid.

9. A method as in claim 1, wherein the plurality of cold plate fluid chilling circuits include at least one beverage component chilling circuit and at least one auxiliary fluid chilling circuit, said flowing step comprises flowing fluid through the at least one auxiliary chilling circuit, and including the steps of flowing a beverage component through the at least one beverage component chilling circuit, and using at least one valve to control fluid placement of the at least one auxiliary fluid chilling circuit, such that in a first state of the at least one valve, said flowing step flows fluid through the at least one cold plate auxiliary fluid chilling circuit and, in a second state of the at least one valve, the auxiliary fluid chilling circuit is switched to be in fluid circuit with the at least one beverage component chilling circuit, so that in the second state of the at least one valve, said step of flowing a beverage component flows the beverage component through both the at least one beverage component chilling circuit and the at least one auxiliary fluid chilling circuit.

10. A method as in claim 9, wherein the at least one valve, in each of its first and second states, couples a supply of the beverage component to the at least one cold plate beverage component chilling circuit.

11. A method as in claim 1, wherein the product at the remote location is liquid beverage product and including the step of fluid coupling the product to a beverage dispensing tower at the remote location.

12. A method as in claim 1, wherein the product at the remote location is carbonated water in a carbonator tank of a remote beverage dispensing tower and including the step of heat exchange coupling the chilled fluid delivered to the remote location to the carbonator tank.

13. A method as in claim 12, including the step of using a carbonator pump of the beverage dispenser to pump water through at least one of the cold plate fluid chilling circuit to a carbonator tank of the beverage dispenser, wherein said delivering step is performed using the carbonator pump.

14. A method as in claim 1, wherein a remote tower is at the remote location, the product at the remote location is a beverage product and including the steps of coupling the product chilled at the remote location to the remote tower, dispensing the chilled product from the remote tower and, in response to said dispensing step, delivering ice to the beverage dispenser cold plate.

15. A method of providing heat exchange cooling at a remote tower through use of a beverage dispenser having a pump and a cold plate with a plurality of fluid chilling circuits, said method comprising the steps of:

using the beverage dispenser pump to flow fluid through a first fluid chilling circuit of the cold plate to chill the fluid;

delivering the chilled fluid to the remote tower; and heat exchange coupling the delivered chilled fluid to a first beverage component at the remote tower to chill the beverage component without contact between the chilled fluid and beverage component.

16. A method as in claim 15, including the step of chilling a second beverage component at the beverage dispenser by using the pump to flow the second beverage component through a second fluid chilling circuit of the cold plate.

17. A method as in claim 16, including the step of terminating said delivering and heat exchange steps by placing the cold plate first fluid chilling circuit in fluid circuit with the second fluid chilling circuit, so that the first fluid chilling circuit is also used to chill the second beverage component.

18. A method as in claim 15, including the steps of dispensing the first beverage component at the remote tower and, in response to said dispensing step, delivering ice to the beverage dispenser cold plate.

19. A method as in claim 15, including the steps of dispensing beverage at the remote tower; sensing performance of said dispensing step; and, in response sensing performance of said dispensing step, delivering ice to the beverage dispenser cold plate.

20. A method as in claim 1, wherein the beverage is one of carbonated water, plain water and beverage syrup.

21. A method of providing a chilled beverage to a beverage dispensing tower separate and remote from a beverage dispenser having a cold plate including at least one beverage chilling circuit, said method comprising the steps of:

chilling the cold plate;

flowing beverage through the at least one beverage chilling circuit of the beverage dispenser cold plate to chill the beverage;

delivering the chilled beverage to the remote beverage dispensing tower; and dispensing the chilled beverage at the remote beverage dispensing tower.

22. A method as in claim 21, wherein said step of chilling the cold plate comprises the step of placing a supply of ice in heat exchange contact with the cold plate.

23. A method as in claim 21, wherein said step of chilling the cold plate comprises the steps of placing the cold plate in a cold plate compartment of the beverage dispenser; and introducing ice into the cold plate compartment and into heat exchange contact with the cold plate.

24. A method as in claim 21, where the beverage is carbonated water.

25. A method as in claim 21, wherein the beverage is plain water.

26. A method as in claim 21, wherein said dispensing step comprises dispensing the beverage from a post-mix valve of the remote tower and the beverage is a beverage syrup.

27. A method as in claim 21, wherein said delivering step comprises flowing the beverage through a closed-loop circulation circuit that includes the at least one cold plate beverage chilling circuit and that extends between the cold plate and the remote beverage dispensing tower, and fluid coupling the closed-loop circulation circuit to a dispensing valve at the remote tower.

28. A method as in claim 27, wherein the beverage is one of carbonated water, plain water and beverage syrup.

* * * * *